US008001654B2

(12) United States Patent
Tomioka et al.

(10) Patent No.: US 8,001,654 B2
(45) Date of Patent: Aug. 23, 2011

(54) WITHDRAWING MECHANISM

(75) Inventors: Kazuyuki Tomioka, Yokohama (JP); Katsuyasu Tomiji, Yokohama (JP)

(73) Assignee: Nifco Inc., Yokohama-Shi, Kanagawa (JP)

( * ) Notice: Subject to any disclaimer, the term of this patent is extended or adjusted under 35 U.S.C. 154(b) by 0 days.

(21) Appl. No.: 12/662,954

(22) Filed: May 13, 2010

(65) Prior Publication Data

US 2010/0223754 A1 Sep. 9, 2010

Related U.S. Application Data

(63) Continuation of application No. PCT/JP2006/322178, filed on Nov. 7, 2006.

(30) Foreign Application Priority Data

Nov. 8, 2005 (JP) ..... 2005-323901
Jun. 27, 2006 (JP) ..... 2006-177115

(51) Int. Cl.
*E05F 3/00* (2006.01)

(52) U.S. Cl. ..... 16/64; 16/62; 16/82; 16/84

(58) Field of Classification Search ..... 16/354, 16/71, 79, 82, 83, 84, 85, 49, 51, 57, 58, 16/61, 62, 66, 69, 70, 63, 64, 65; 292/216, 292/279, 160, 304, DIG. 15, 280
See application file for complete search history.

(56) References Cited

U.S. PATENT DOCUMENTS

| | | | | |
|---|---|---|---|---|
| 4,369,545 | A * | 1/1983 | Maublanc | 16/64 |
| 5,343,593 | A * | 9/1994 | Fayngersh | 16/52 |
| 5,502,874 | A * | 4/1996 | Lucas | 16/62 |
| 6,131,242 | A * | 10/2000 | Zipperle et al. | 16/82 |
| 6,262,548 | B1 * | 7/2001 | Scholten et al. | 318/445 |
| 6,848,759 | B2 * | 2/2005 | Doornbos et al. | 312/319.1 |
| 7,036,852 | B2 * | 5/2006 | Cho | 292/33 |
| 2001/0008037 | A1 * | 7/2001 | Brustle | 16/71 |
| 2004/0232708 | A1 * | 11/2004 | Arabia et al. | 292/216 |
| 2005/0212302 | A1 * | 9/2005 | Fisher | 292/216 |

FOREIGN PATENT DOCUMENTS

| | | | |
|---|---|---|---|
| JP | 2001262931 | A * | 9/2001 |
| JP | 2005201344 | A * | 7/2005 |

* cited by examiner

*Primary Examiner* — Victor Batson
*Assistant Examiner* — Jeffrey O Brien
(74) *Attorney, Agent, or Firm* — Manabu Kanesaka

(57) ABSTRACT

A withdrawing mechanism includes a striker disposed on one of a swingable member and a main body, a catcher disposed on the other of the swingable member and the main body to capture the striker moving, and a damper for applying a damping force to a turning operation of then catcher toward the turned position. The catcher is turnable between a standby position and a turned position. The catcher is biased towards the standby position when at a position closer to the standby position than an intermediate position between the standby position and the turned position and biased toward the turned position when at a position closer to the turned position than the intermediate position. The catcher includes a hooking groove for the striker on a surface extending substantially perpendicular to a rotary shaft thereof. The hooking groove faces an introduction port toward the front side in the standby position.

10 Claims, 20 Drawing Sheets

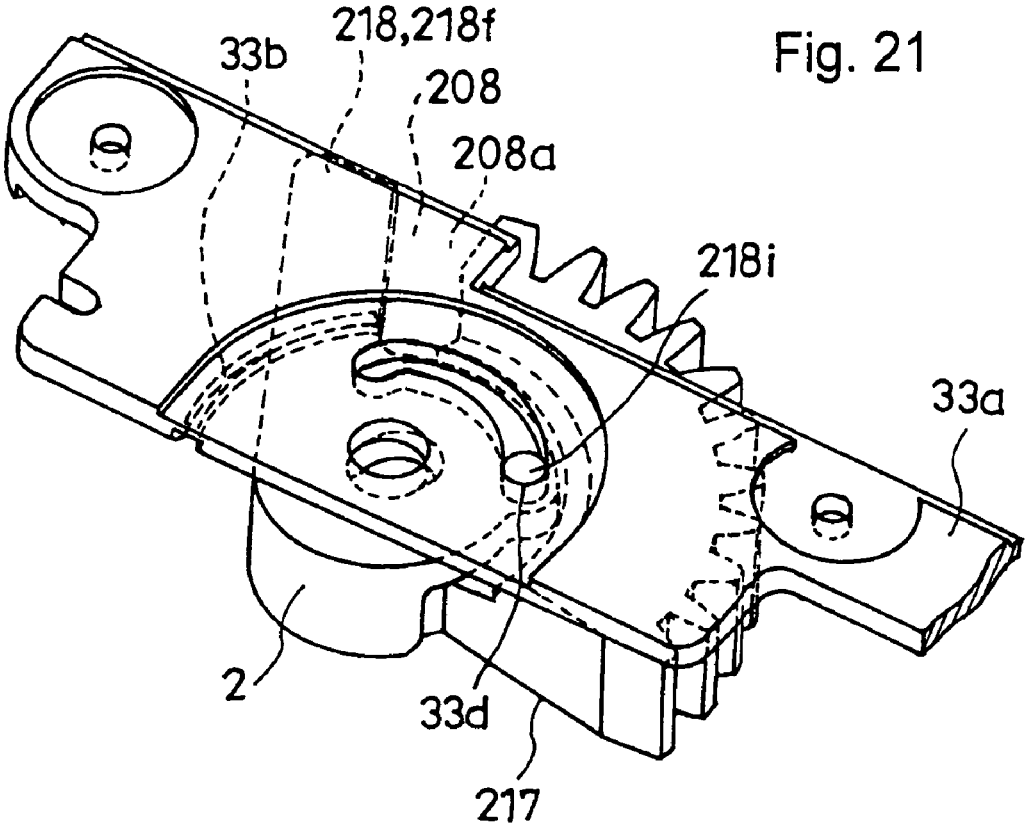
Fig. 21
Fig. 22
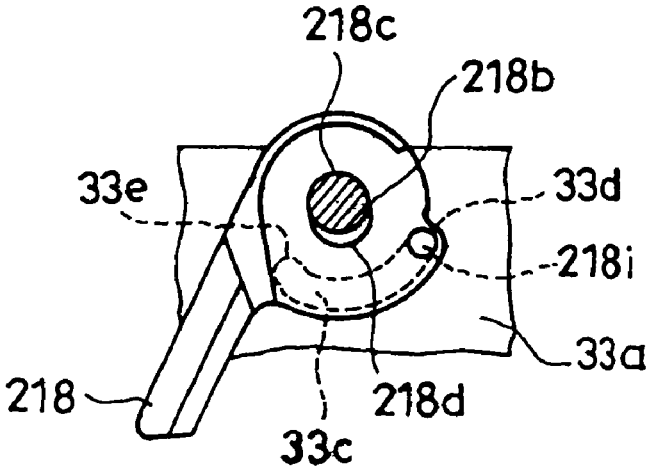

WITHDRAWING MECHANISM

CROSS-REFERENCE TO RELATED APPLICATION

This is a divisional application of Ser. No. 12/149,477 filed on May 2, 2008.

TECHNICAL FIELD

The present invention relates to an improved withdrawing mechanism for absorbing impact, which is caused when a swingable member is swung from an open position to a reference position as in, e.g. a case where a door is closed.

BACKGROUND ART

A conventional door-opening device, which includes a retractable pin disposed to a door and a turnable plate disposed on a housing, has been disclosed in Patent Document 1. The turnable plate has a spiral slot formed therein and is configured to be stably set in both of a position with the opening of the spiral slot directed to a front direction (standby position) and a position with the opening of the spiral slot directed to a depth direction (turned position) by a spring, which has one end fixed at a position away from the pivot thereof and the other end fixed to the housing. When the door is swung toward to a closed position, the retractable pin enters the spiral slot of the turnable plate set in the standby position, and the turnable plate is turned toward the turned position. When the turnable plate is turned beyond the maximum extension of the spring, the turnable plate is forcibly turned toward the rotated position under the action of the spring. Thus, the door is swung toward the closed position, i.e. a position to close the opening of the housing and is set in the closed position.

However, the device disclosed in Patent Document 1 has a first problem in that it is in such a dilemma that if an attempt is made to increase the damping force of a damper for damping a swinging operation in order to absorb impact caused during swinging the door toward the closed position, the resistance to the swinging operation of the door toward the closed position increases while if an attempt is made to decrease the resistance, it is difficult to properly absorb the impact caused when the door is swung hard. The device has a second problem in that in a case where the turnable plate has been turned into the turned position for some reason with the door opened; even if the door is closed, the retractable pin is prevented from entering the spiral slot of the turnable plate set in the turned position, which leads to operation wherein the turnable plate is required to be returned to the standby position. The device has a third problem in that since the retractable pin is disposed on a free end of the door, the device cannot withdraw the door until just before the door is about to be closed. The device has a fourth problem in that the turnable plate and the damper for damping a swinging operation need to have a certain depth for installation since the damping force is generated by bringing a gear disposed in the damper into direct engagement with a sector gear formed on the turnable plate.

Patent Document 1: JP-A-2005-127527 (See Paragraphs 0080 and 0081, and FIG. 30 to FIG. 32)

DISCLOSURE OF THE INVENTION

Problems to be Solved by the Invention

It is a first one of the primary objects of the present invention to provide a mechanism including a swingable member, such as a door, (corresponding to the door in Patent Document 1), which is capable of acting in response to the swinging speed of the swingable member toward the closed position (in other words, in response to the magnitude of the kinetic energy of the swingable member) so that when the kinetic energy is large, a larger damping force is applied to the swinging operation of the swingable member while when the kinetic energy is small, a smaller damping force is accordingly applied to the swinging operation of the swingable member, with the result that when the swinging operation of the swingable member is hard, the swinging operation is effectively damped while when the swingable member is normally swung from an open position toward the reference position, the resistance to the swinging operation is prevented from being excessive at a certain swung position and thereafter.

It is a second object of the present invention to provide a mechanism, which, even if a striker disposed on the swingable member (corresponding to the retractable pin in Patent Document 1) for capturing the striker by a catcher (corresponding to the turnable plate in this document) is improperly set in the turned position with the swingable member being opened, is capable of swinging the swingable member to the reference position to cause the catcher to properly capture the striker in order to return the catcher to a desired position.

It is a third object of the present invention to provide a mechanism, which is capable of withdrawing the swingable member from a position where the swingable member has swung toward the reference position to some extent.

It is a fourth object of the present invention to provide a mechanism, which is capable of disposing the catcher and a damper without excessively extending the length in a depth direction (the length extending along the moving direction of the swingable member).

Means for Solving the Problems

In order to attain the above-mentioned objects, according to a first aspect of the present invention, there is provided a withdrawing mechanism, which includes:

(1) a striker disposed on one of a swingable member and a main body with the swingable member swingably assembled thereto;

(2) a catcher disposed on the other and configured to capture the striker moving or relatively moving from a front side of the catcher when the swingable member is swung from an open position toward a reference position; and (3) a load response type damper;

(4) wherein the catcher is configured to be turnable forward and backward throughout between a standby position and a turned position and to capture the striker in the standby position and turn forward up to the turned position; and (5) wherein the damper is configured to apply a damping force to a turning operation of the catcher toward the turned position.

In a case where the swingable member is swung from an open position toward the reference position, when the swingable member is swung up to a certain swung position, the striker disposed on the swingable member is captured by the catcher in the standby position. The catcher, which has captured the striker, is turned up to the turned position by the swinging force of the swingable member. When the swingable member is swung at such a high speed that the catcher is turned at a high speed, the damper applies a corresponding and relatively large damping force to the turning operation of the catcher. When the swingable member is swung at such a low speed that the catcher is turned at a low speed, the damper applies a corresponding small damping force to the turning operation of the catcher. Thus, it is possible to effectively damp the swinging operation when the swingable member is swung hard, while it is possible to prevent the resistance from being excessive at the certain swung position and thereafter when the swingable member is normally swung toward the reference position. For example, the damper may include a piston and a cylinder and be configured to provide a resistance of a viscous fluid sealed in the cylinder to a depression movement of the piston, and be further configured so that the viscous fluid applies a larger resistance to the piston as the piston is subjected to a larger load (the piston is moved at a higher speed), such as the damper disclosed in JP-A-2005-188693 by the applicant.

The withdrawing mechanism may be configured so that the damper includes a piston and a cylinder and is configured to provide a resistance of a viscous fluid sealed in the cylinder to a depression movement of the piston; and that the catcher has a pinion formed thereon, and a slider having a rack engageable with the pinion is disposed; and that the slider is combined with the piston of the damper.

In this mode, the damper can apply a damping force to the turning operation of the catcher through the slid slider by the catcher turned toward the turned position. In particular, the damper may be disposed at a position lateral to the catcher.

The withdrawing mechanism may be configured so that the damper includes a piston and a cylinder and is configured to provide a resistance of a viscous fluid sealed in the cylinder to a depression movement of the piston;

that the damper is housed between a piston rod fit-in portion connected to the piston and a fit-in portion for a rear end of the cylinder remote from a projecting end of the piston rod;

that the catcher has a pinion formed thereon, and a coupling pinion is disposed at a position lateral to the catcher;

that there are disposed a first slider having a rack engageable with the pinion of the catcher and with the coupling pinion, and a second slider having a rack engageable with the coupling pinion on a side remote from the first slider; and that one of the piston rod fit-in portion and the fit-in portion for the rear end of the cylinder is moved by a movement of the first slider, and the other is moved by a movement of the second slider.

In this mode, when the catcher captures the striker and is turned toward the turned position, while the first slider has the rack brought into engagement with the pinion of the catcher, the second slider, the rack of which is brought into engagement with the coupling pinion on a side opposite to the first slider, is moved toward the reverse direction to the first slider. By this arrangement, the fit-in portion at the rear end of the cylinder and the piston rod fit-in portion can be moved so as to be brought close to each other. In this way, the first slider and the second slider can cause the piston to be pushed into the cylinder forming the damper by a greater turning amount than the turning amount of the catcher that is turned from the standby position to the turned position. Thus, the damping force of the load response type damper can be maximally applied to the swingable member just before the swingable member is set in the reference position.

The withdrawing mechanism may further include a casing having at least two mounting surfaces in a stepped fashion, the withdrawing mechanism being adapted to be mounted to the main body through the casing.

In this mode, even if an object to mount the withdrawing mechanism according to the present invention has a stepped portion, the withdrawing mechanism can be mounted, having the two mounting surfaces of the casing adapted to the stepped portion.

The withdrawing mechanism may be configured so that the catcher is configured so as to be biased toward the standby position when being at a position closer to the standby position than an intermediate position between the standby position and the turned position and to be biased toward the turned position when being at a position closer to the turned position than the intermediate position;

that the catcher includes a hooking groove for the striker on a surface thereof extending substantially perpendicular to a rotary shaft thereof, the hooking groove facing an introduction port toward the front side in the standby position;

that the hooking groove has opposed walls, one of which is formed of a latch biased to project from a base surface of the surface; and that when the catcher is set in the turned position, the one wall of the hooking groove is configured to be set in a position closer to the front side than the other wall, and at least one portion of the latch is configured to be located on a moving track of the striker.

In this mode, in a case where the swingable member is swung from an open position toward the reference position, when the swingable member is swung up to the certain swung position, the striker disposed on the swingable member enters the hooking groove of the catcher in the standby position and is captured therein. The catcher, which has captured the striker, is turned (forward) beyond the intermediate position by the swinging operation of the swingable member toward the reference position and is turned up to the turned position by the biasing action. The swingable member, the striker of which has been captured by the catcher, is forcibly swung up to the reference position by the turning operation of the catcher. On the other hand, when the swingable member, which is set in the reference position as described above, is swung toward an open position, the catcher, which has captured the striker at the turned position, is turned (backward) beyond the intermediate position by the movement of the striker and is set in the standby position by the biasing action. In the standby position, the striker escapes from the hooking groove to be released from the catcher since the introduction port of the hooking groove is faced toward the front side. Thus, the swingable member is released. On the other hand, the catcher is kept in the standby position by the biasing action until the swingable member is swung toward the reference position next. In a case where although the swingable member is not set in the reference position, the catcher is improperly set in the turned position (an improper operation state), when the swingable member is swung up to the reference position, the striker is brought into contact with the latch forming the one wall of the hocking groove to depress the latch against the biasing force, and then the striker can be captured, at a deeper position than the latch by the hooking groove of the catcher set in the turned position since the latch is elastically projected. Thus, the withdrawing mechanism can be restored to a proper operation state even after the withdrawing mechanism has been set in the improper operation state.

The withdrawing mechanism may be configured so that the latch has an inclined surface formed at a portion thereof on a side thereof, which faces outward when the catcher is set in the turned position, which is located on the moving track of the striker, and which is gradually raised toward a top of the latch and faces toward the front side.

In this mode, the striker is brought into contact with the inclined surface of the catcher in the turned position from the front side when the swingable member is swung up to the reference position in the improper operation state. Thus, the latch can be smoothly depressed against the biasing force, being assisted by the inclined surface.

The withdrawing mechanism may be configured so that the latch includes a seat, which has an outer profile formed in a substantially rectangular parallelepiped shape, and the latch is assembled to the catcher, having the seat housed in a guide slot so as to be movable in an extending direction of the guide slot, the guide slot having a slot shape following the outer profile of the seat; and that the seat has a length substantially extending along the moving track of the striker when the catcher is set in the turned position.

The withdrawing mechanism may be configured so that the seat has ribs formed on both sides extending along a longitudinal direction of the seat and at positions close to a front end of the seat of the latch, which is located on the front side when the catcher is set in the turned position, the ribs extending along a moving direction of the seat; and that the guide slot has guide grooves formed so as to house the ribs.

In this mode, although the striker is brought, from the front side, into contact with the latch of the catcher in the turned position and depresses the latch against the biasing force when the swingable member is swung up to the reference position in the improper operation state, the latch can be reliably depressed, minimizing, e.g. the inclination of the seat of the latch.

The withdrawing mechanism may be configured so that the seat has auxiliary ribs formed on both ends so as to extend along the moving direction of the seat; and that the guide slot has auxiliary guide grooves formed so as to house the auxiliary ribs.

In this mode, in a case where the swingable member is swung up to the reference position in the improper operation state, when the striker is brought, from the front side, into contact with the latch of the catcher in the turned position, it is possible to minimize the inclination of the seat of the latch in a width direction of the seat. In this case, the latch can be reliably depressed.

The withdrawing mechanism may be configured so that the catcher is configured so as to be biased toward the standby position when being at a position closer to the standby position than an intermediate position between the standby position and the turned position and to be biased toward the turned position when being at a position closer to the turned position than the intermediate position;

that the catcher comprises a combination of a main part and a sub-part;

that the main part and the sub-part are configured to define a hooking groove for the striker, which has an introduction port facing the front side in the standby position, and to move the sub-part in a direction to expand the introduction port of the hooking groove as the catcher is turned backward to the standby position.

In this mode, when the catcher is set in the turned position, the width of the hooking groove is set at such a value that the striker can be housed with slight play, while when the catcher is set in the standby position, the striker can be properly introduced into the hooking groove through the introduction port even if a slight shift or misalignment occurs in the moving track of the striker.

The withdrawing mechanism may be configured so that the sub-part has an elongated hole with a rotary shaft of the catcher passing therethrough and includes a slider, which is guided in a trace groove formed in a supporter for the rotary shaft at a position lateral to the rotary shaft and extending in an arced shape; and that the sub-part is configured to be slid in a length range of the elongated hole according to a change in a pitch between the trace groove and the rotary shaft as the catcher turns backward toward the standby position.

In this mode, the sub-part of the catcher, which is turned backward from the turned position, locates the rotary shaft at one end of the elongated hole just before the catcher is set in the standby position, and when the catcher is set in the standby position, the sub-part is moved to locate the rotary shaft at the other end of the elongated hole since the slider of the sub-part is pushed by the trace groove. This movement can widen the introduction port of the hooking groove of the catcher in the standby position.

The withdrawing mechanism may be configured so that the main part of the catcher has a pinion formed thereon so as to be engageable with a rack of a slider;

that there is disposed an assist part, which has a toothed portion formed thereon so as to be brought into engagement with the rack of the slider at a different position from the main part when the catcher is set at least in the intermediate position; and that the assist part is configured to apply a biasing force to the slider in engagement with the catcher in the intermediate position to assist a turning operation of the catcher toward the turned position.

In this mode, when the catcher is turned forward to the intermediate position, the assist part applies a biasing force to the slider, with the result that the catcher can be smoothly turned toward the turned position beyond the intermediate position. Thus, the swingable member can be reliably swung up to the reference position.

The withdrawing mechanism may be configured so that the striker comprises a pin, which is assembled to a striker base so as to be capable of retracting a protruded portion against a biasing force, the protruded portion projecting from the striker base by the biasing force; and that the sub-part is configured to have an outer edge located on a moving track of the striker when the catcher is set in the turned position.

In this mode, in a case where although the swingable member is not set in the reference position, the catcher has been improperly set in the turned position (in the improper operation state), when the swingable member is swung up to the reference position, the pin forming the striker is brought into contact with the outer edge of the sub-part and is retracted against the biasing force, the pin is allowed to climb over the sub-part. When the pin has climbed over the sub-part, the pin is protruded again, allowing the striker to be captured by the hooking groove of the catcher in the turned position. Thus, the withdrawing mechanism can be restored to the proper operation state.

In order to mainly attain the third object, according to a second aspect of the present invention, there is provided a withdrawing mechanism, which includes:

(1) a striker disposed on one of a swingable member and a main body with the swingable member swingably assembled thereto, the striker being disposed at a position close to a hinged end of the swingable member;

(2) a catcher disposed on the other and configured to capture the striker moving or relatively moving from a front side of the catcher when the swingable member is swung from an open position toward a reference position; and (3) a damper;

(4) wherein the catcher is configured to be turnable forward and backward throughout between a standby position and a turned position and to capture the striker in the standby position and turn forward up to the turned position; and (5) wherein the damper is configured to apply a damping force to a turning operation of the catcher toward the turned position.

By this arrangement, it is possible to cause the catcher to capture the striker and to withdraw the swingable member, applying a damping force to the swingable member in such a state wherein the swingable member has been swung toward the reference position to some extent.

In order to mainly attain the fourth object, according to a third aspect of the present invention, there is provided a withdrawing mechanism, which includes:

(1) a striker disposed on one of a swingable member and a main body with the swingable member swingably assembled thereto;

(2) a catcher disposed on the other and configured to capture the striker moving or relatively moving from a front side of the catcher when the swingable member is swung from an open position toward a reference position; and (3) a damper;

(4) wherein the catcher is configured to be turnable forward and backward throughout between a standby position and a turned position and to capture the striker in the standby position and turn forward up to the turned position;

(5) wherein the catcher has a pinion formed thereon, and a slider having a rack engageable with the pinion is disposed and (6) wherein the damper is configured to apply a damping force to the slider, which is moved by a turning operation of the catcher toward the turned position.

By this arrangement, in particular, the damper may be disposed at a position lateral to the catcher (in a direction intersecting with the swinging direction of the swingable member). It is also possible to dispose the catcher and the damper without excessively extending the length in the depth direction.

When the swingable member is formed of a fixture swingably disposed in a house, or a member swingably assembled to equipment in a house, it is possible to prevent the fixture from making impact or impact noise in the reference position, i.e. in the closed position even if the fixture flaps in the wind. It is also possible to provide the fixture with premium environment.

When the swingable member is formed of a member swingably assembled to the main body of an electrical appliance, it is possible to prevent such a member from making impact or impact noise in the reference position even if such a member is swung hard from an open position toward the reference position. It is also possible not only to prevent internal and external parts of the electrical appliance from being damaged due to such impact but also to provide the movement of such a member with premium environment.

When the swingable member is formed of a member swingably assembled to the main body of business equipment, it is possible to prevent such a member from making impact or impact noise in the reference position even if such a member is swung hard from an open position toward the reference position. It is also possible not only to prevent internal and external parts of the business equipment from being damaged due to such impact but also to provide the movement of such a member with premium environment.

When the swingable member is formed of an exterior member or an interior member swingably assembled to a main body forming an automobile, it is possible to prevent, in particular the exterior member from making impact or impact noise in the reference position even if the exterior member flaps in the wind. On the other hand, in the case of the interior member, it is possible to prevent the interior member from making impact or impact noise in the reference position even if such the interior member is swung hard from an open position toward the reference position. It is also -possible not only to prevent internal and external parts of the automobile from being damaged due to such impact but also to provide the movement of the exterior member or the interior member with premium environment.

EFFECTS OF THE INVENTION

In accordance with the withdrawing mechanism of the present invention, it is possible, as a first advantage, to act in response to the swinging speed of the swingable member toward the reference position so that when the kinetic energy is large, a larger damping force is applied to the swinging operation of the swingable member while when the kinetic energy is small, a smaller damping force is accordingly applied to the swinging operation of the swingable member, with the result that when the swinging operation of the swingable member is hard, the swinging operation is effectively damped while when the swingable member is normally swung from an open position toward the reference position, the resistance to the swinging operation is prevented from being excessive at a certain swung position and thereafter. In other words, it is possible to effectively damp the swinging speed of the swingable member toward the reference position if the swingable member is swung hard in an unusual way, while it is possible to prevent a large force from being applied to the swinging operation of the swingable member toward the reference position in a normal situation.

It is possible, as a second advantage, to swing the swingable member to the reference position to cause the catcher to properly capture the striker in order to return the catcher to a desired position even if the striker disposed on the swingable member for capturing the striker by the catcher is improperly set in the turned position with the swingable member being opened.

It is possible, as a third advantage, to cause the catcher to capture the striker and to withdraw the swingable member, applying a damping force to the swingable member in such a state wherein the swingable member has been swung toward the reference position to some extent.

It is possible, as a fourth advantage, to dispose the catcher and the damper without excessively extending the length in the depth direction.

BRIEF DESCRIPTION OF THE DRAWINGS

FIG. 21 is a perspective view of essential parts of the withdrawing mechanism in the state shown in FIG. 20;

FIG. 22 is a perspective view of essential parts of the withdrawing mechanism in the state shown in FIG. 20;

BEST MODE FOR CARRYING OUT THE INVENTION

Now, the best modes for carrying out the invention will be described based on FIG. 1 to FIG. 25.

Figure 1:
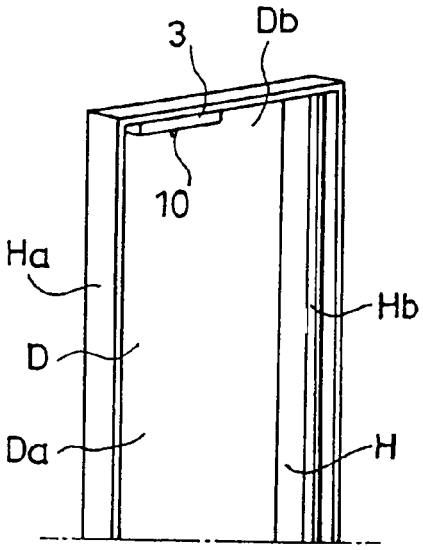
FIG. 1 is a perspective view of a swingable member D with a withdrawing mechanism.
Figure 2:
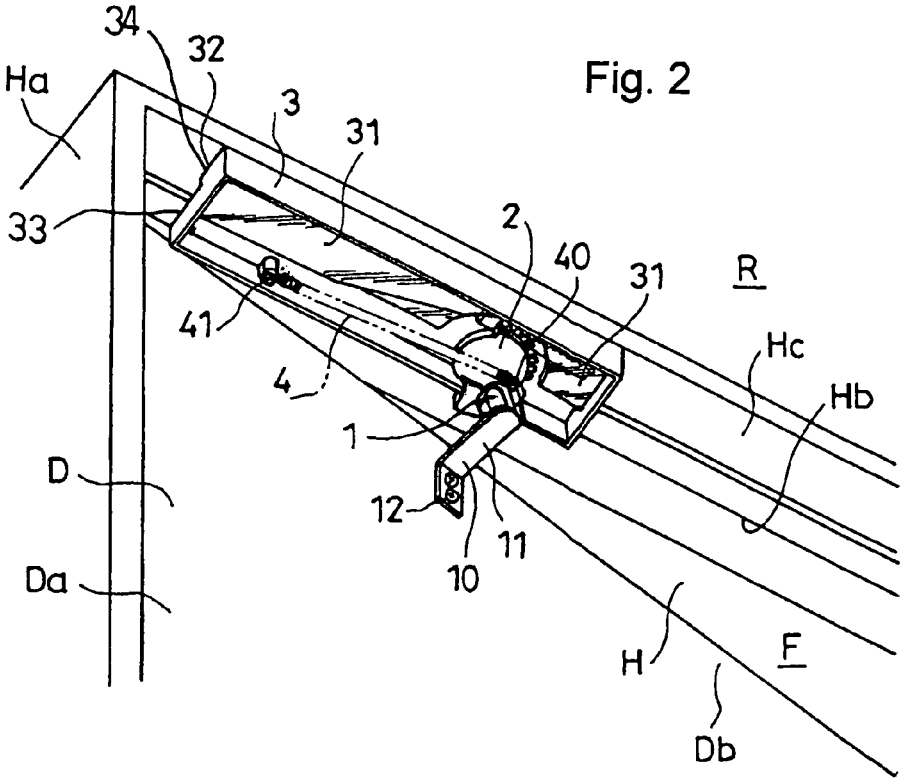
FIG. 2 is a perspective view of essential parts of the swingable member.
Figure 3:
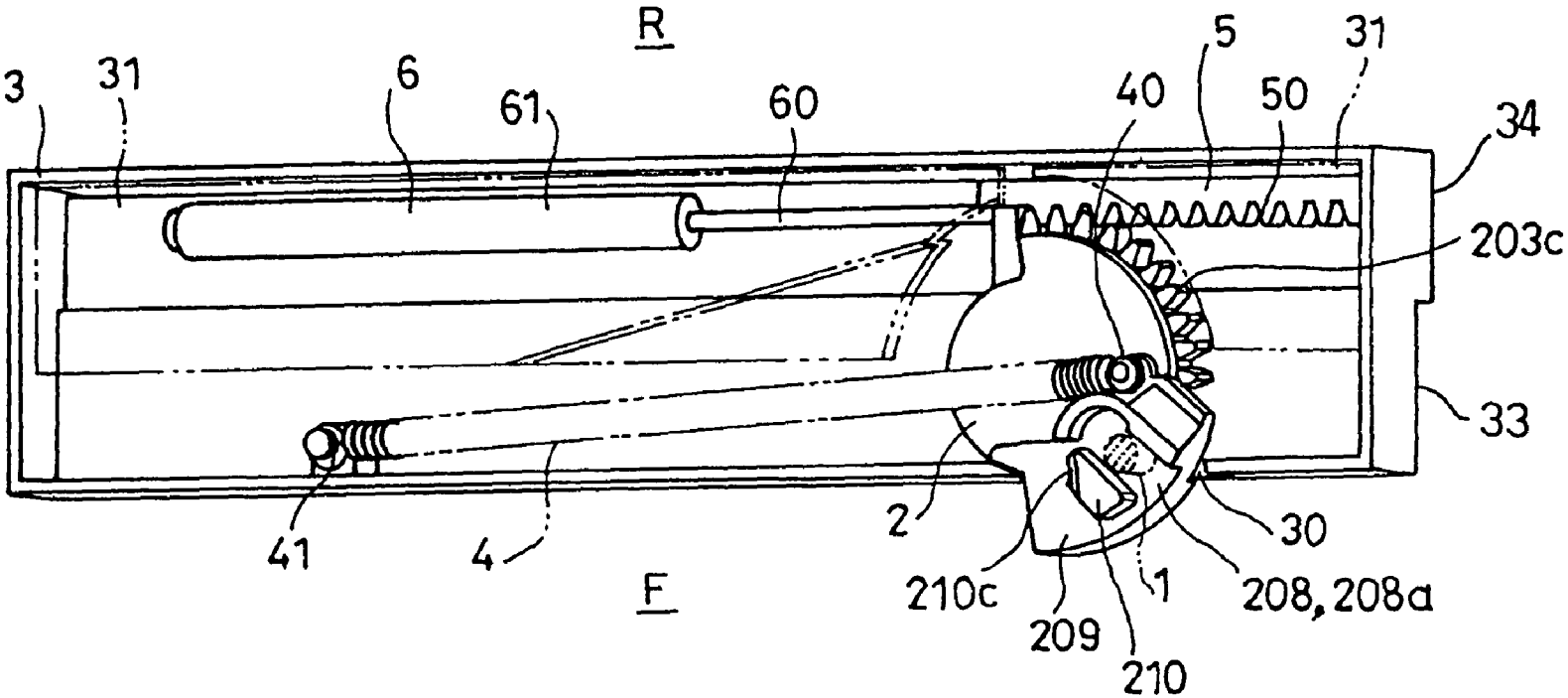
FIG. 3 is a perspective view of the withdrawing mechanism in the state shown in FIG. 2.

FIG. 1 to FIG. 3 show a state wherein a catcher 2 forming the withdrawing mechanism according to the present invention is set in a standby position and wherein a swingable member D has been swung in a certain swung position with the catcher 2 capturing a striker 1. FIG. 1 shows an upper portion Db of the swingable member D, FIG. 2 shows the upper portion Db in an enlarged view, and FIG. 3 shows essential parts of the withdrawing mechanism in this state.

Figure 4:
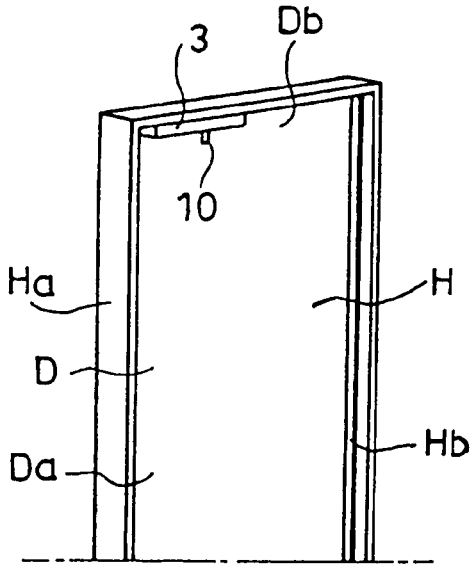
FIG. 4 is a perspective view of the swingable member D with the withdrawing mechanism.
Figure 5:
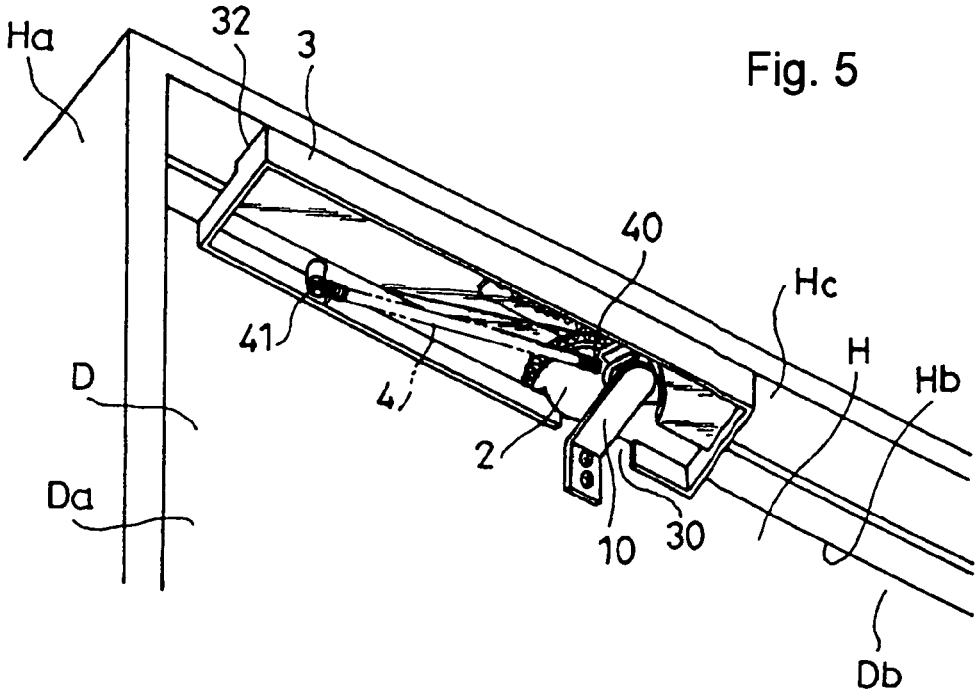
FIG. 5 is a perspective view of the essential parts of the swingable member.
Figure 6:
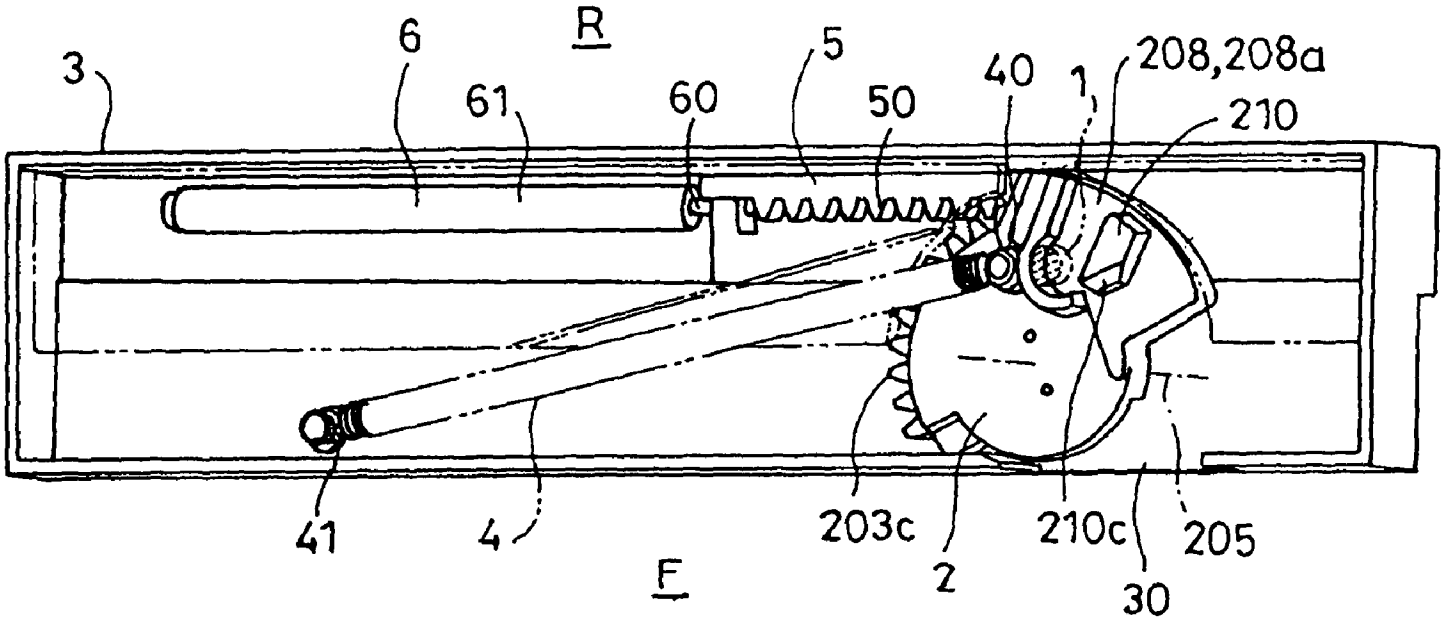
FIG. 6 is a perspective view of the withdrawing mechanism in the state shown in FIG. 5.
Figure 7A:
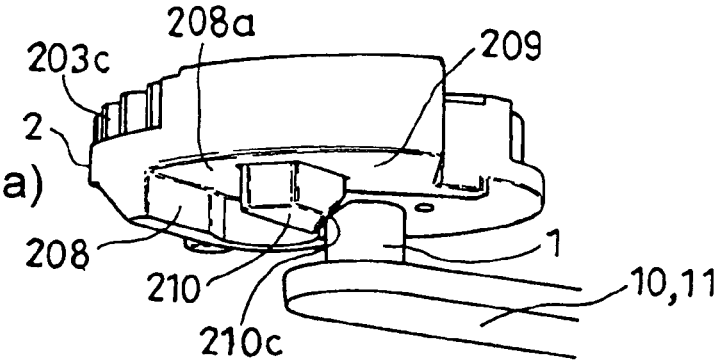
FIG. 7 contains perspective views showing the operation of a latch 210 forming a catcher 21 when correcting improper operation.
Figure 7B:
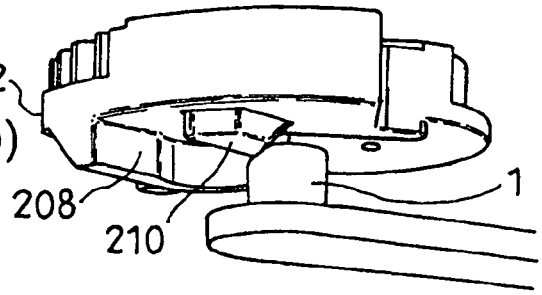
Figure 7C:
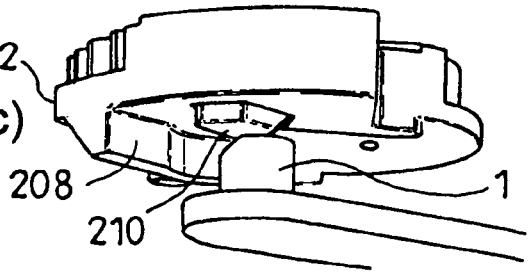
Figure 7D:
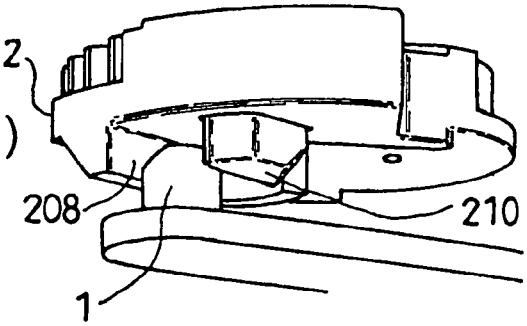

FIG. 4 to FIG. 6 show a state wherein the catcher 2 forming the withdrawing mechanism according to the present invention is set in a turned position, and wherein the catcher 2 in this position has captured the striker 1 to set the swingable member D in a reference position. FIG. 4 shows the upper portion Db of the swingable member D, FIG. 5 shows the upper portion Db in an enlarged view, and FIG. 6 shows essential parts of the withdrawing mechanism in this state.

FIGS. 7(*a*), (*b*), (*c*) and (*d*) stepwise show the catcher 2 and the striker 1 in a state wherein the swingable member D is swung toward the reference position in a case where the catcher 2 is turned in the turned position without the swingable member D being set in the reference position. The striker 1 disposed on the swingable member D moves in a depth direction in the order of FIGS. 7(*a*), (*b*), (*c*) and (*d*) and climbs over a latch 210 of the catcher 2, finally entering a hooking groove 208.

Figure 8:
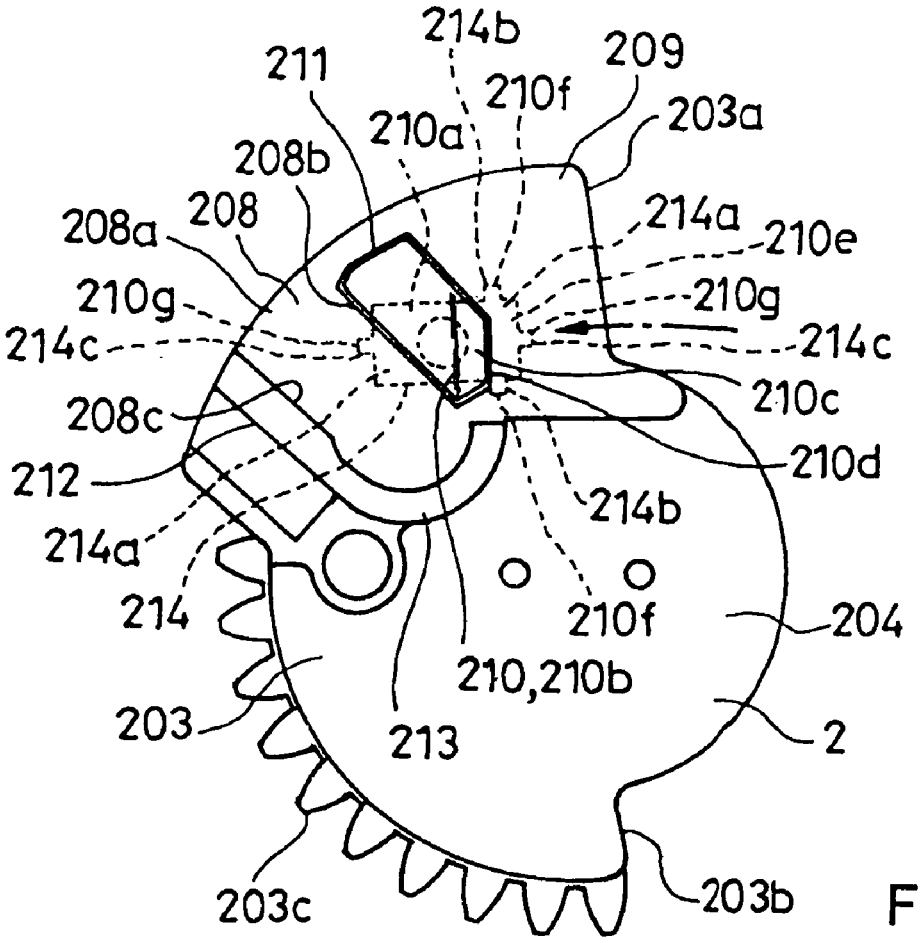
FIG. 8 is a bottom view of the catcher 2.
Figure 9:
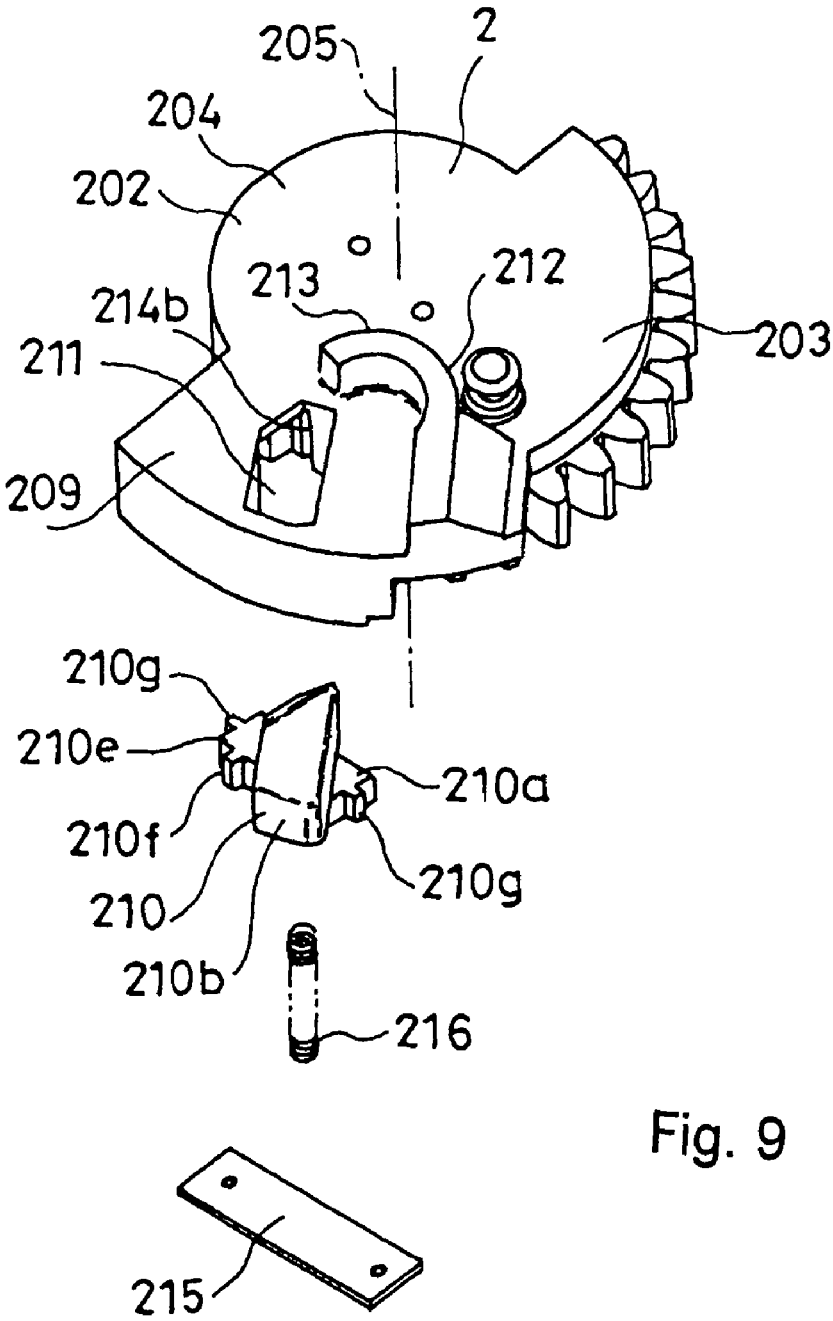
FIG. 9 is an exploded perspective view showing the catcher 2.
Figure 10:
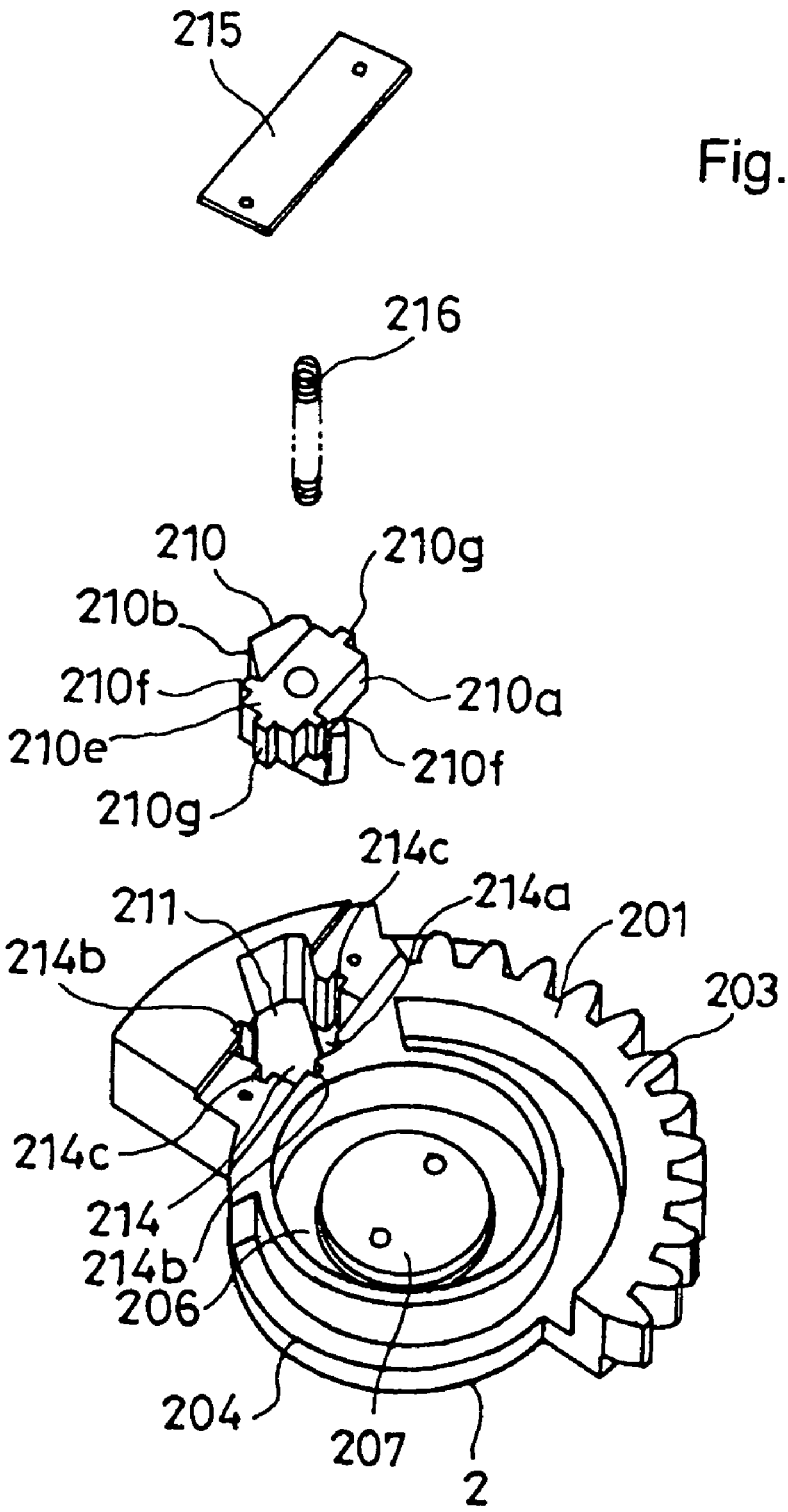
FIG. 10 is an exploded perspective view showing the catcher 2 (seen from the side opposite to FIG. 9)

FIG. 8 shows the catcher 2 seen from its bottom side 202 (wherein the moving track of the striker 1, which follows when the swingable member D is swung toward the reference position in a case where the catcher 2 is turned in the turned position, is indicated by an arrow of chain line). Each of FIG. 9 and FIG. 10 shows the respective parts forming the catcher 2 in an exploded view.

Figure 11:
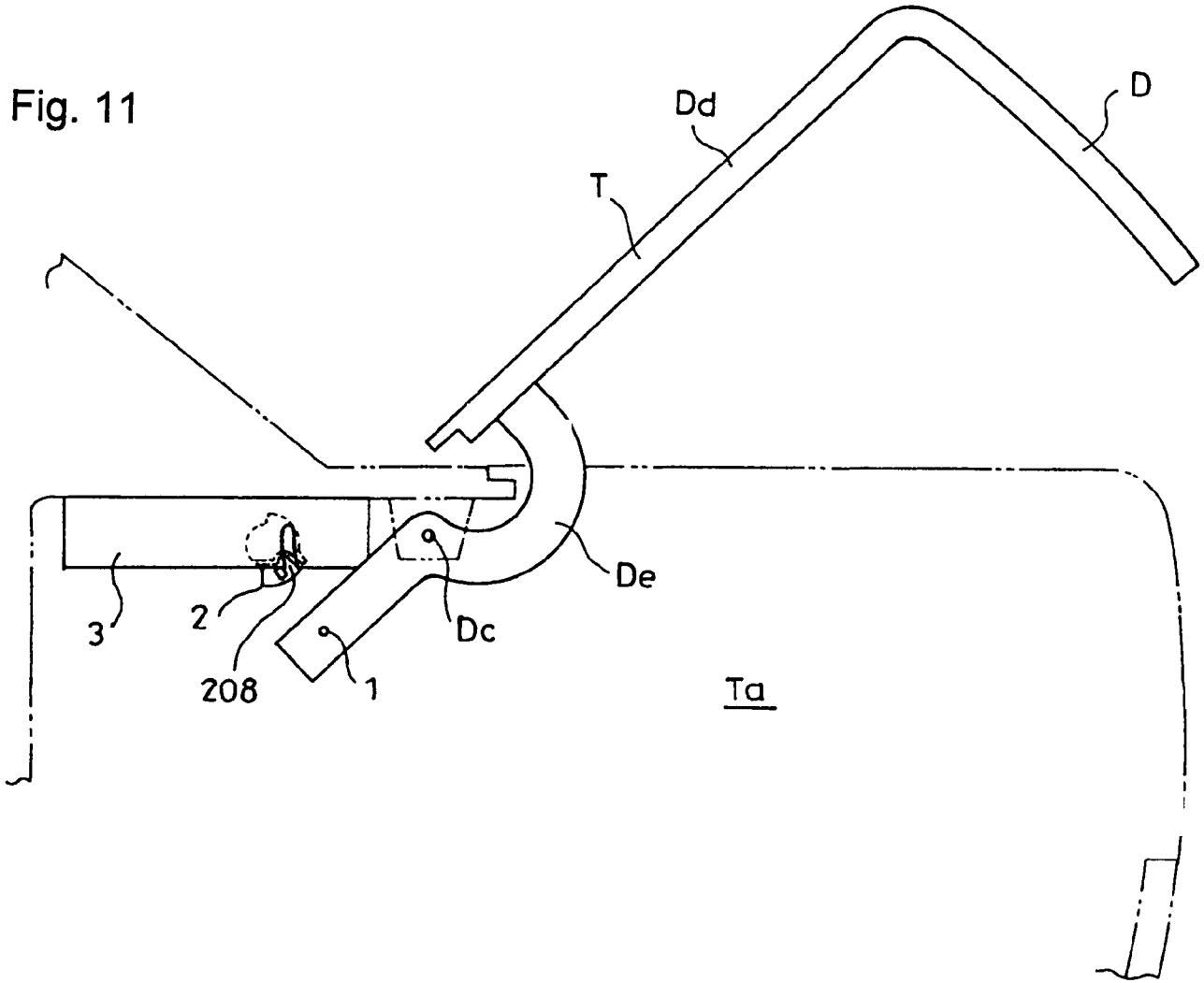
FIG. 11 is a schematic view of the withdrawing mechanism, which is used for a different application.
Figure 12:
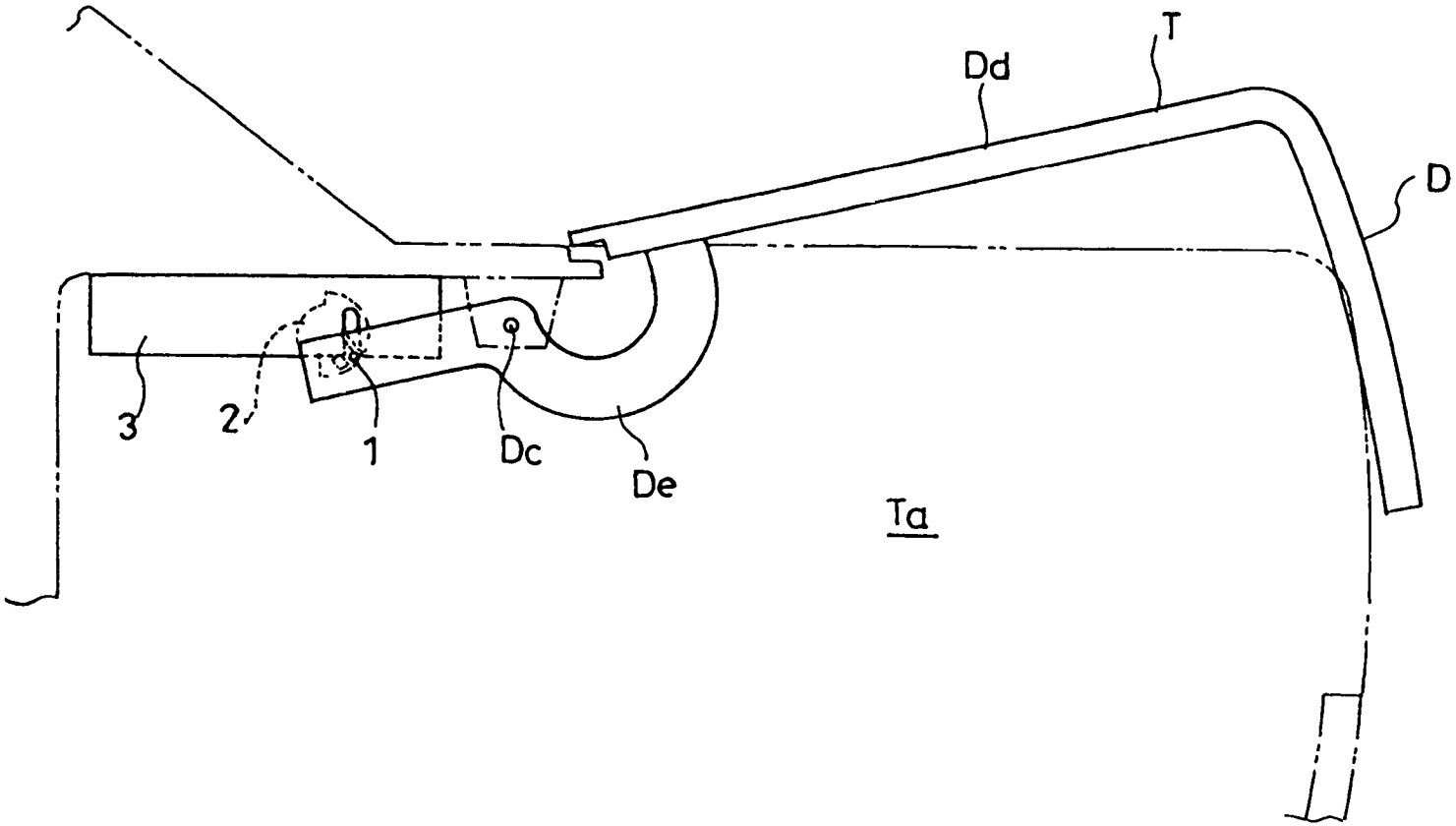
FIG. 12 is a schematic view of the withdrawing mechanism, which is used for the different application.

FIG. 11 and FIG. 12 show an application where the swingable member D forms a trunk lid T. FIG. 12 shows a state wherein the trunk lid T has just been captured by a catcher disposed on an automobile body and set in the standby position after the trunk lid has been swung toward the reference position from the state shown in FIG. 11.

Figure 13:
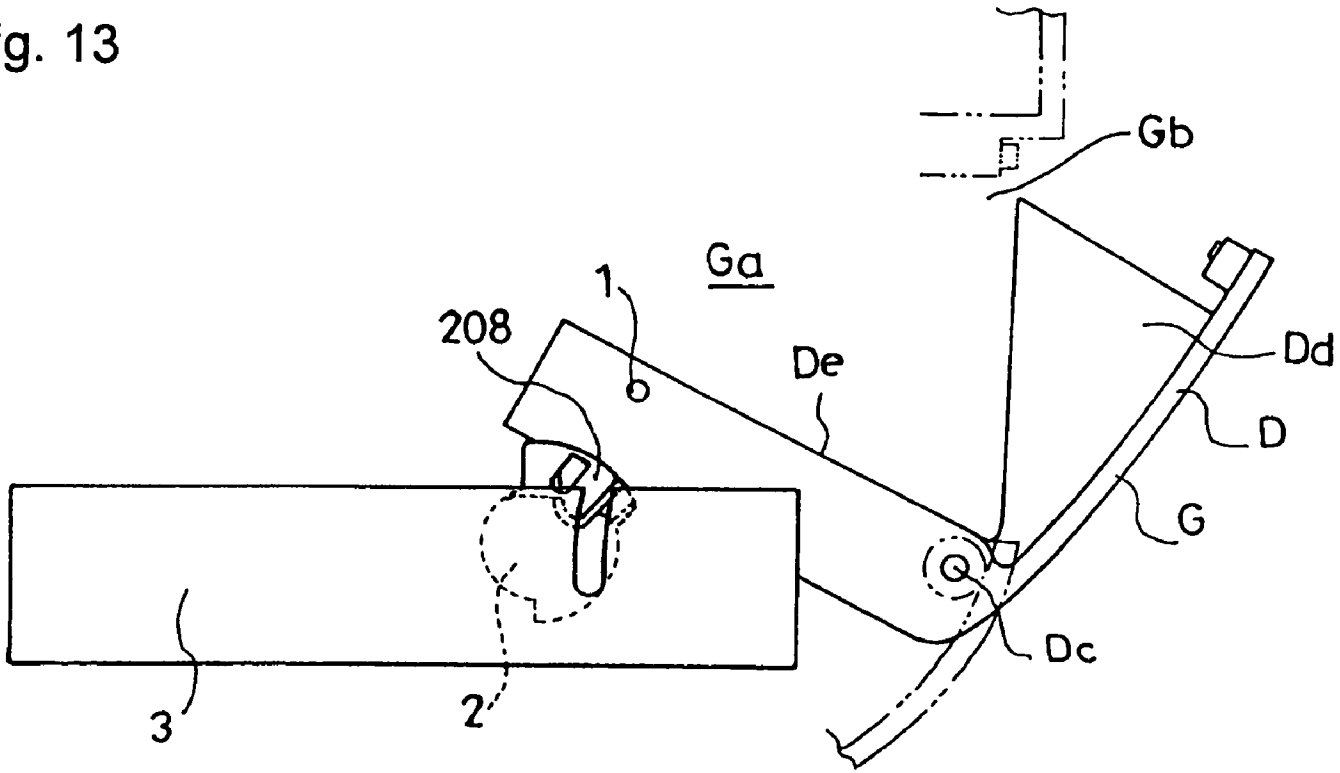
FIG. 13 is a schematic view of the withdrawing mechanism, which is used for another different application.

FIG. 13 shows an application where the swingable member D forms a glove box G.

Figure 14:
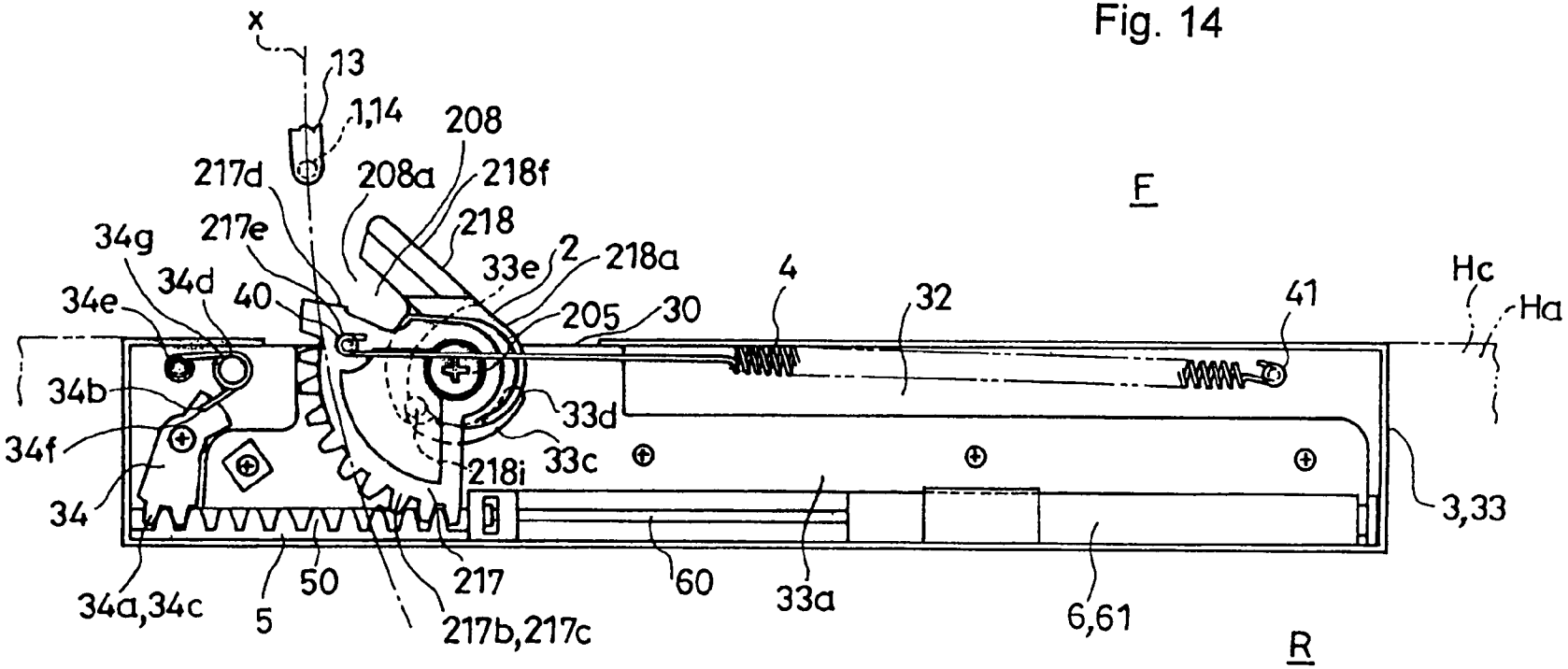
FIG. 14 is a schematic bottom view of essential parts of the withdrawing mechanism according to a modified embodiment.
Figure 15:
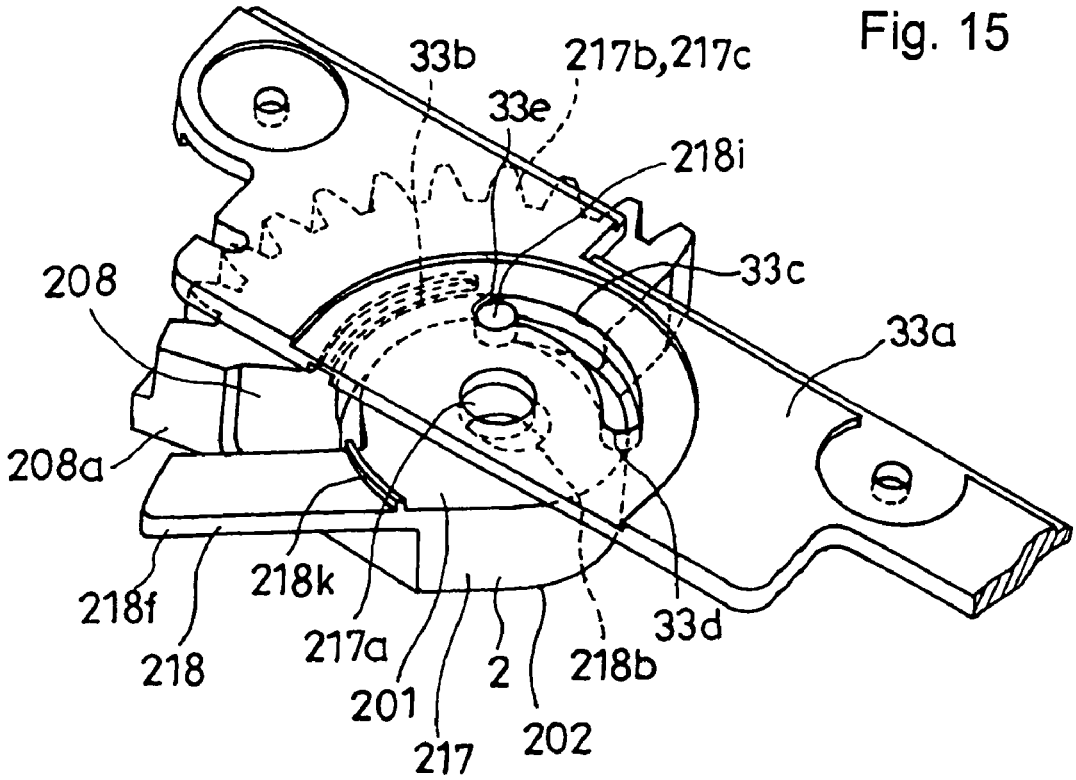
FIG. 15 is a perspective view of essential parts of the withdrawing mechanism in the state shown in FIG. 14.
Figure 16:
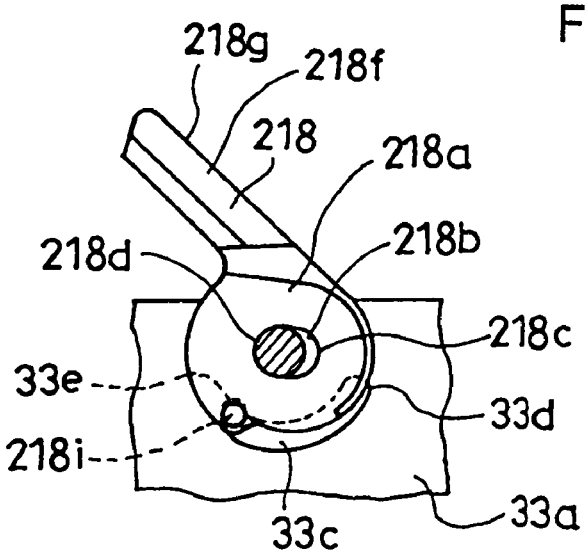
FIG. 16 is a perspective view of essential parts of the withdrawing mechanism in the state shown in FIG. 14.
Figure 17:
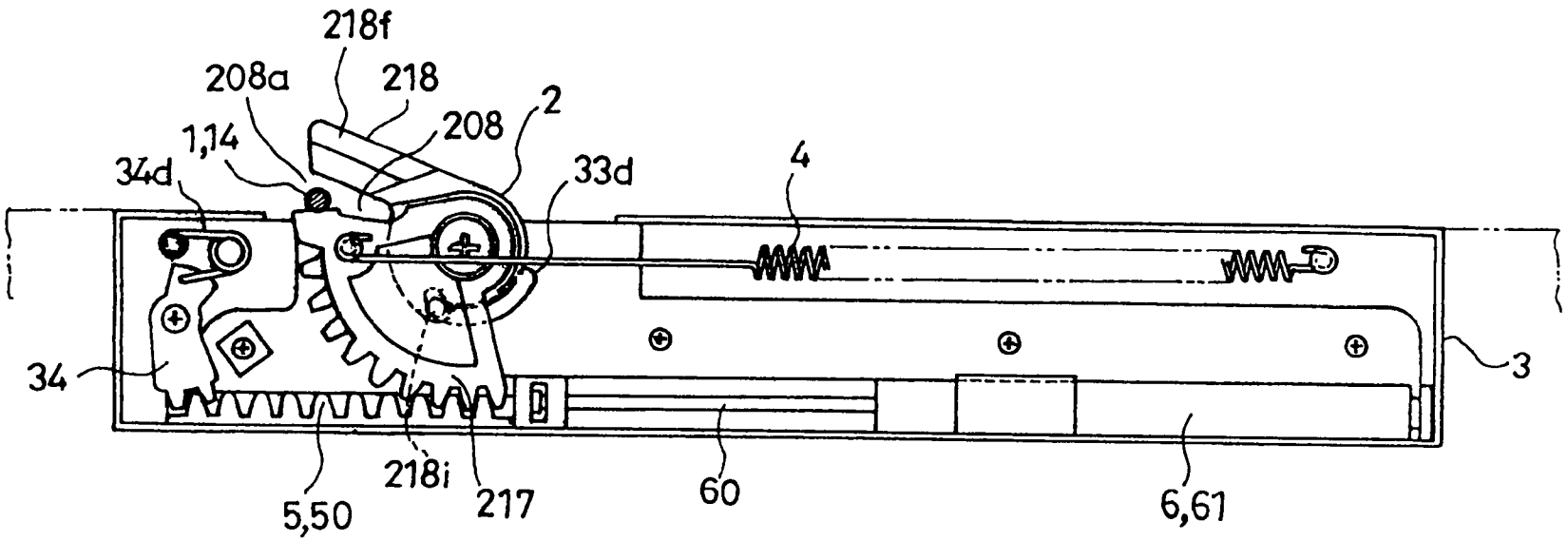
FIG. 17 is a schematic bottom view of essential parts of the withdrawing mechanism according to the modified embodiment.
Figure 18:
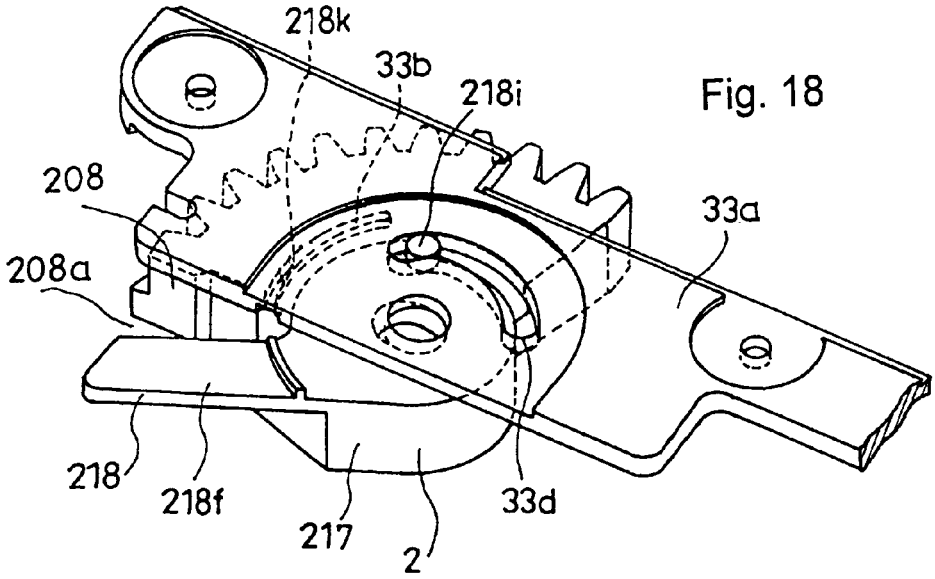
FIG. 18 is a perspective view of essential parts of the withdrawing mechanism in the state shown in FIG. 17.
Figure 19:
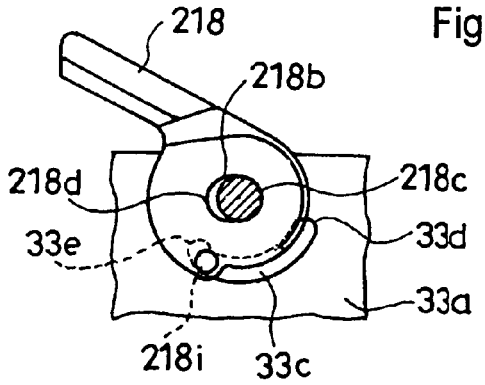
FIG. 19 is a perspective view of essential parts of the withdrawing mechanism in the state shown in FIG. 17.
Figure 20:
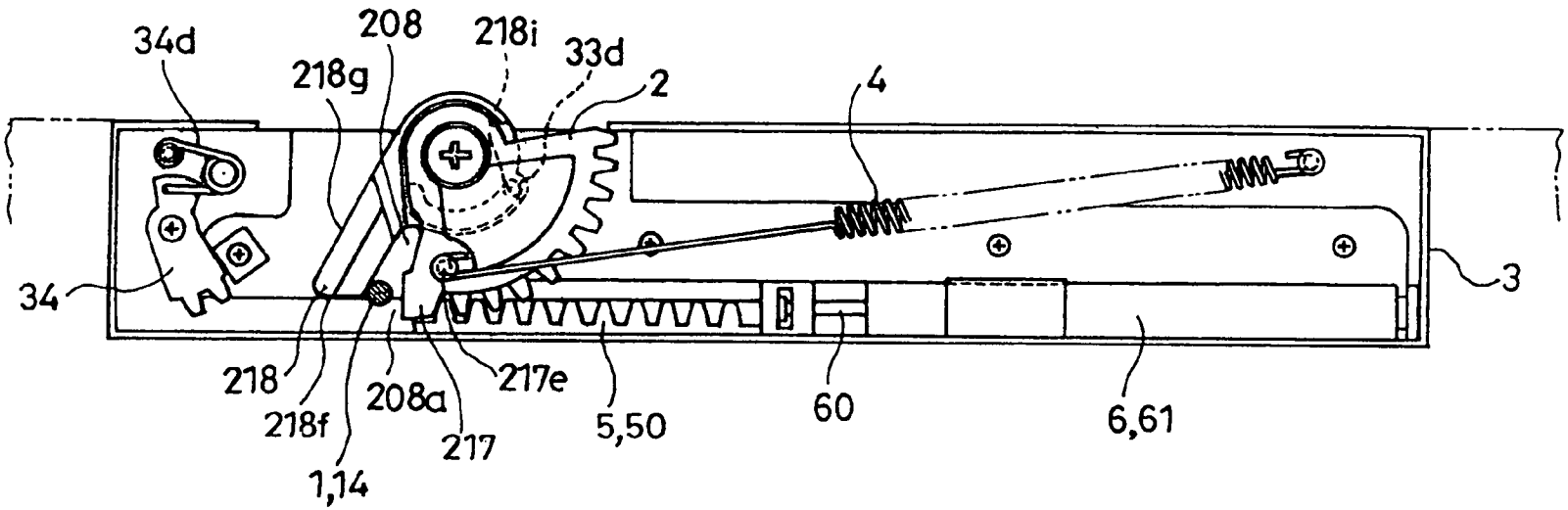
FIG. 20 is a schematic bottom view of essential parts of the withdrawing mechanism according to the modified embodiment.

FIG. 14 to FIG. 24(*c*) show another embodiment wherein the structure of the withdrawing mechanism shown in FIG. 1 to FIG. 10 is partly modified. Specifically, FIG. 14 to FIG. 16 show a state wherein the catcher 2 is set in the standby position, FIG. to FIG. 19 show a state wherein the catcher 2 has just passed an intermediate position, and FIG. 20 to FIG. 22 show a state wherein the catcher 2 is set in the turned position. (It should be noted that the withdrawing mechanism is seen from below in each of FIG. 14, FIG. 17 and FIG. 20, that the catcher 2 is seen from above in each of FIG. 15, FIG. 18 and FIG. 21, and that the positional relationship of a sub-part 218 and a rotary shaft 205 forming the catcher 2 is mainly shown with a main part 217 or the like forming the catcher being omitted in each of FIG. 16, FIG. 19 and FIG. 22.)

Figure 23:
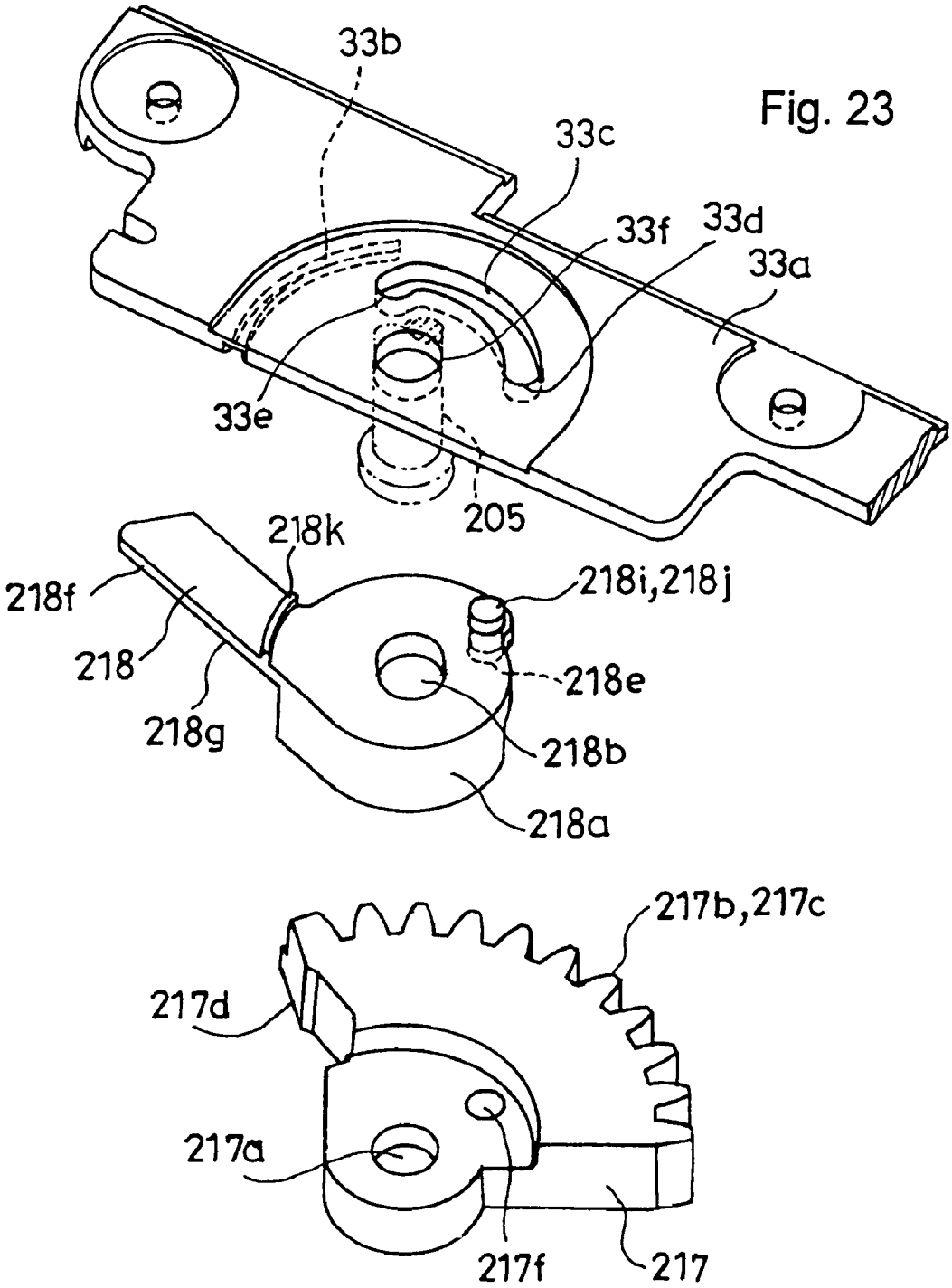
FIG. 23 is an exploded perspective view of the catcher of the withdrawing mechanism according to the modified embodiment.
Figure 24A:
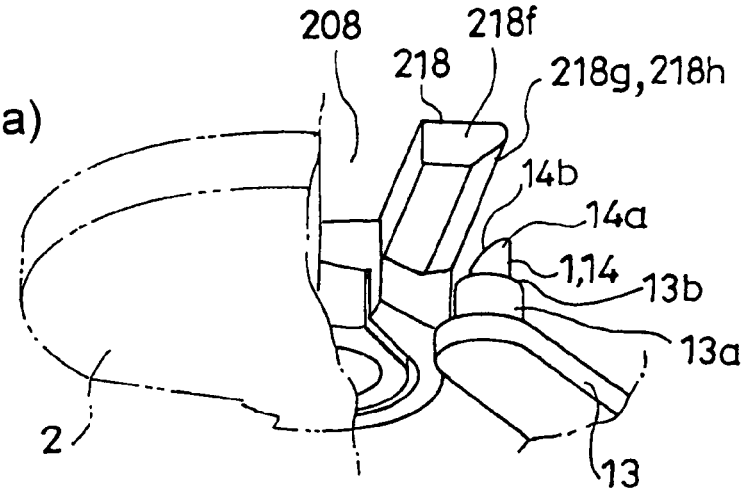
FIG. 24 is a perspective schematic view of essential parts of the catcher.
Figure 24B:
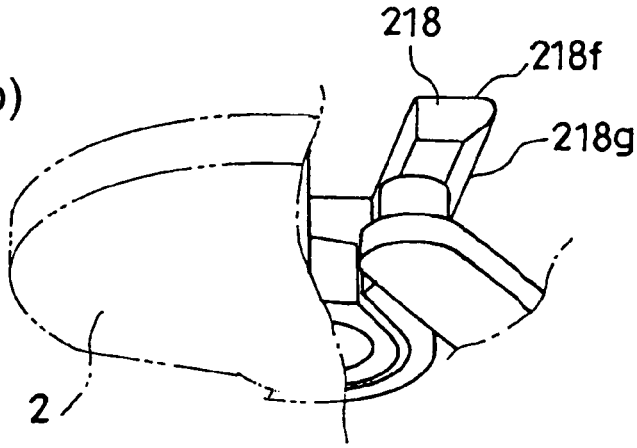
Figure 24C:
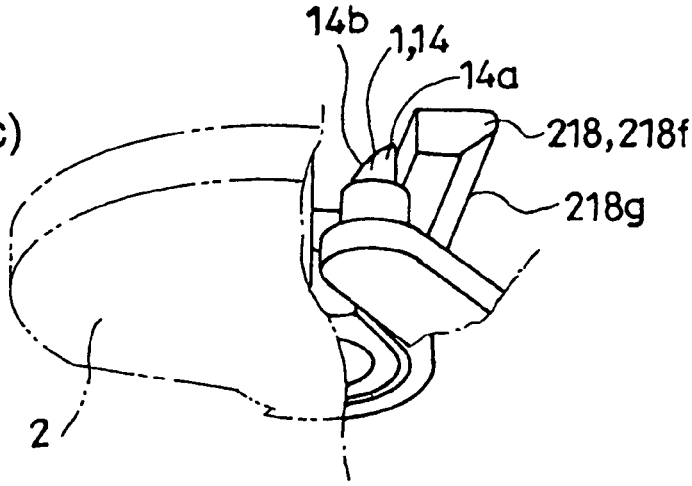

FIG. 23 shows the main part 217 and the sub-part in an exploded view. FIGS. 24(*a*), (*b*) and (*c*) show how a pin 14 forming the striker 1 moves when the swingable member D is swung toward the reference position in a case where the catcher has been improperly set in the turned position. The pin 14 moves from a forward direction F in the order of FIGS. 24(*a*), (*b*) and (*c*) and is captured and brought into engagement with the hooking groove 208 of the catcher 2 set in the turned position.

Figure 25:
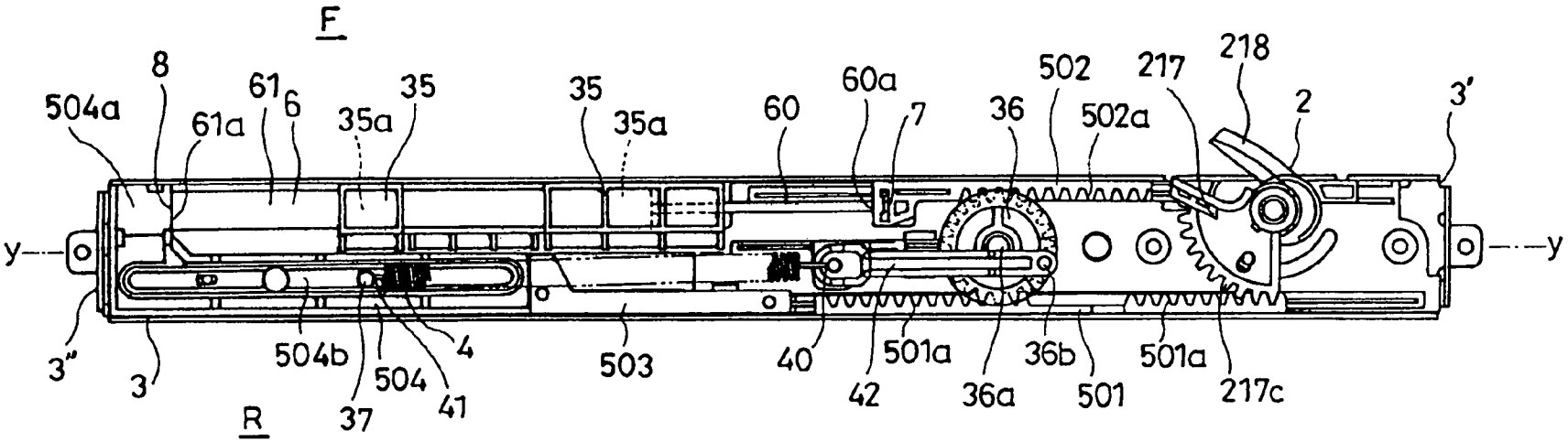
FIG. 25 is a schematic bottom view of essential parts of the withdrawing mechanism according to another modified embodiment.

FIG. 25 shows another embodiment wherein the structure of the withdrawing mechanisms shown in FIG. 14 to FIG. 24(*c*) is partly modified.

The withdrawing mechanism according to each of the embodiments has the purpose of absorbing impact, which is caused when the swingable member D set in an open position is swung toward the reference position. Further, the withdrawing mechanism according to each of the embodiments has the purpose of stably setting the swingable member D in the reference position by forcing the swingable member D swung toward the reference position to be withdrawn into the reference position from a certain swung position.

The swingable member D is expected to be typically used as the following members:

(1) Fixture swingably disposed in a house, and member swingably assembled to equipment in a house door for closing an opening of a building, such as a front entrance, and a room entrance door for furniture and household equipment, such as a built-in kitchen and a cupboard toilet seat and toilet lid (2) Member swingably assembled to the main body of an electrical appliance door for a refrigerator, a washing machine, a drying machine, a rice cooker, a dishwasher and a cooking appliance lid for a rice cooker, an electric pot and a vacuum cleaner
display unit for a cellular phone
air grill for an air-conditioner
front panel for a coin-operated game machine, such a pinball machine and a slot machine (3) Member swingably assembled to the main body of business equipment various kinds of swingable members forming a printer or a copy machine
display unit for a laptop computer (4) Exterior member or interior member swingably assembled to the body of an automobile (including a portion of an interior member, such as the holding section of a cup holder)

right or left door, rear door
swingably operable roof panel
swingably openable assist grip
foldable table
swingably openable hook
sun visor
rear view mirror
swingably erectable display unit for a car-audio system or a car navigation system
swingably openable holding section of a cup holder
filler cap
trunk lid
bonnet
lid for a glove box
swingably openable armrest
tonneau cover
backrest for a seat In the embodiment shown in FIG. 1 to FIG. 7(*d*), the swingable member D forms a door as an example, which has one end swingably hinged and supported on a main body, i.e. an opening H in this embodiment, so as to be swingably assembled to the main body, and is configured to shut the opening H, having the other end opposite to the hinged end Da, brought into contact with, e.g. a door jamb or door head Hb of a door frame Ha.

In this. embodiment, the striker 1 forming the withdrawing mechanism is disposed on the swingable member D at a position close to the hinged end, and the catcher 2 and a damper 6 are accordingly disposed on the main body. By this arrangement, the catcher 2 is allowed to capture and withdraw the striker 1 and to apply a braking force to the swinging operation of the swingable member D when the swingable member D has been swung toward the reference position to some extent (FIG. 2), which is different from a case where these members are disposed at a position close to the free end of the swingable member D.

The withdrawing mechanism according to this embodiment is formed of the striker 1 and the catcher 2.

The striker 1 is disposed on the swingable member D (the door in the shown embodiment).

In the shown embodiment, the catcher 2 is disposed on a bottom side of an upper section Hc of the door frame Ha at a position slightly spaced from the hinged end Da as described later. The striker 1 is accordingly disposed on the upper portion Db of the swingable member D at a position slightly spaced from the hinged end Da. Specifically, the striker 1 is disposed on an end of a first arm 11 of an L-character shaped member 10 so as to project as a shaft upward from an outer bent surface of the L-character shaped member. The striker 1 is configured to be disposed on the swingable member D by fixing the L-character shaped member 10 to one side of the swingable member D by use of a second arm 12 of the L-character shaped member 10.

The catcher 2 is disposed on the opening H, which can be closed by the swingable member D. The catcher 2 is configured to capture the striker 1 when the swingable member D is set at a certain swung position in a case where the striker is brought close to the catcher from a front side F (forward side in the shown embodiment) by swinging the swingable member D from an open position toward the reference position.

In the shown embodiment, the catcher 2 is disposed on the bottom side of the upper section Hc of the door frame Ha so as to be slightly spaced from the hinged end Da.

In the shown embodiment, the catcher 2 is turnably incorporated in a casing 3, which has an open bottom and is formed as a box having a substantially rectangular parallelepiped shape. The casing 3 has a top wall, through which the casing 3 is mounted to the upper section Hc of the door frame Ha to dispose the catcher 2 on the upper section Hc of the door frame Ha.

The top wall of the casing 3 is stepped in a longitudinal direction thereof. Both sides of the stepped position on the top wall serve as mounting surfaces 33 and 34 for the upper section Hc. A lower mounting surface 33 of the two mounting surfaces is brought into contact with an abutting surface of the door head Hb, and the upper mounting surface 34 is brought into contact with a lower surface of the upper section Hc on a depth side of the door head Hb. Thus, the withdrawing mechanism is mounted to the opening H through the casing.

This arrangement allows the casing 3 to be disposed, absorbing the stepped form of the door head Hb, with the result that it is possible to minimize the length of the withdrawing mechanism projecting toward inside the opening H.

In the shown embodiment, the casing 3 has the catcher 2 disposed in one end thereof, and the casing 3 is disposed on the upper section Hc so as to have the other end at a position close to the hinged end Da of the swingable member D and to have a longitudinal direction extending along the longitudinal direction of the upper section Hc. The casing 3 has a notched portion 30 formed in a side wall on the one end with the catcher 2 and facing the front side F. The catcher 2 partly projects outward from the notched portion 30 when being set in the standby position described later. When the swingable member D is swung up to the certain swung position, the striker 1 enters the hooking groove 208 of the catcher 2 in the standby position and passes the intermediate position, with the result that the catcher 2 is turned to the turned position to withdraw the striker 1 into the casing 3 so as to set the swingable member D in the reference position, closing the swingable member D. In the shown embodiment, reference numeral 31 designates a cover for closing an open portion of the casing 3 on the depth side R.

The catcher 2 is configured so as to be turnable between the standby position and the turned position and is also configured so as to be biased toward the standby position when being at a position closer to the standby position than the intermediate position between the standby position and the turned position and to be biased toward the turned position when being at a position closer to the turned position than the intermediate position.

In the shown embodiment, the catcher 2 includes a semicircular plate 203 and an arced projection 204 laterally projecting form a substantially central portion of the chord of the semicircular plate 203. The catcher 2 has a top side turnably assembled to the top wall 32 of the casing 3 so as to locate a rotary shaft 205 at the center of an imaginary circle containing the outer peripheral edge of the semicircular plate 203. Specifically, in the shown embodiment, the catcher 2 has a circular groove 206 formed in the top side to define a short circular projection 207 and is configured so as to be turnable by inserting the short circular projection 207 in an unshown bearing formed in the top wall 32 of the casing 3 and setting the rotary shaft 205 in a substantially perpendicular direction. When the semicircular plate 203 partly projects through the notched portion 30 toward the front side F, and when one of two edges of the chord, which are left between the outer peripheral edge of the semicircular plate 203 and the arced projection 204 (hereinbelow, one of the two edges is called a first chord edge 203*a*, and the. other is called a second chord edge 203*b*), is brought into contact with an edge of the notched portion close to the other end of the casing 3, the catcher 2 is set in the standby position (the position shown in FIG. 3). The catcher 2 has the hooking groove 208 described later formed on a bottom side 202 at a portion of the semicircular plate 203, which projects outward from the casing 3 in the standby position. The hooking groove 208 is configured to extend toward the rotary shaft 205 from the outer peripheral edge of the semicircular plate 203, being spaced from the first chord edge 203*a*, and to be open on the outer peripheral edge, serving an introduction port 208*a* for the striker 1. The catcher 2 is configured to be turnable around the rotary shaft 205 throughout between the standby position and the turned position with the introduction port 208 of the hooking groove 208 facing the depth direction (the position shown in FIG. 6).

In the shown embodiment, the catcher 2 is biased as described above by a tension coil spring 4, which is housed in the casing so as to have a front spring end 40 fixed to a lateral side of a closed depth end of the hooking groove 208 close to the second chord edge 203*b* and a rear spring end 41 fixed to the other end of the casing 3. The front spring end 40 of the spring 4 is fixed at a position closer to the outer peripheral edge of the semicircular plate 203 than the rotary shaft 205 of the catcher 2. The front spring end 40 of the spring 4 is disposed on the one end of the casing 3 so that the spring 4 is extended by a maximum length in the intermediate position of the catcher 2 where the front spring end 40 of the spring 4, the rotary shaft 205 of the catcher 2 and the rear spring end 41 of the spring 4 are set on the same imaginary line.

By this arrangement, the catcher can be stably set by the biasing action of the spring 4 irrespective whether the catcher is set in the standby position or the turned position.

The catcher 2 includes the hooking groove 208 for the striker 1 on a surface extending substantially perpendicular to the rotary shaft 205 (the bottom side 202 of the catcher 2 in the shown embodiment), the hooking groove facing the introduction port 208*a* toward the front side F in the standby position. The hooking groove 208 has opposed walls, one wall 208*b* of which is formed of the latch 210, which is biased to project from a base surface 209 (the bottom side of the semicircular plate 203 in the shown embodiment) of the above-mentioned surface (the bottom side 202).

In the shown embodiment, the semicircular plate 203 has (1) a long latch slot 211 formed therein at a position close to the first chord edge 203*a* so as to extend from the outer peripheral edge of the semicircular plate 203 toward the rotary shaft 205, (2) a first rib 212 formed thereon so as to extend from the outer peripheral edge of the semicircular plate 203 toward the rotary shaft 205, being spaced from the latch slot 211, and (3) a second rib 213 formed thereon so as to extend between an end of the first rib 212 close to the rotary shaft 205 of the catcher 2 and an end of the latch slot 211 close to the rotary shaft of the catcher 2 and being continuous with the first rib 212. The second rib 213 is curved so as to have an inner curved side facing the hooking groove 208, serving as the depth end of the hooking groove 208.

The catcher 2 has a guide slot 214 formed in the top side 201 so as to communicate with the latch slot 211. The guide slot 214 is formed so as to intersect the latch slot 211, having a slot shape extending in a direction to intersect the longitudinal direction of the latch slot 211. On both sides of the latch slot 211 in the longitudinal direction, the guide slot 214 has a receiving surface 214*a* formed on a portion of a bottom thereof so as to serve as a seat 210*a* of the latch 210, which will be described later.

The latch 210 includes the seat 210*a*, which has an outer profile formed in a substantially rectangular parallelepiped shape. The latch is assembled to the catcher 2, having the seat 210*a* housed in the guide slot 214 so as to be movable in the extending direction of the guide slot, the guild slot being formed so as to have the slot shape following the outer profile of the seat 210*a*. The seat 210*a* has a head 210*b* integrally formed on a bottom side 202 so as to intersect the seat 210*a* and to extend in a direction to intersect the longitudinal direction of the seat 210*a*.

In the shown embodiment, the latch 210 is inserted in the guide slot 214 communicating with the latch slot 211 so as to have the head 210*b* housed in the guide slot 211 and projecting from the latch slot, with the head 210*b* facing downward. The seat 210*a* of the latch 214, which is housed as described above, is covered with a retaining plate 215, which is fixed to the top side of the catcher 2. The retaining plate 215 and the seat 210*a* have a compression coil spring 216 housed therebetween in an elastically deformed state, bringing the seat 210*a* into contact with the receiving surface 214*a*. Thus, only the head 210*b* elastically projects downward from the latch slot 211. In the shown embodiment, the head 210*b* of the latch 210, which is projected as described above, defines the one wall 208*b* of the hooking groove 208, and the first rib 212 defines the other wall 208*c* of the hooking groove 208.

When the catcher 2 is set in the turned position, the one wall 208*b* of the hooking groove 208 is set in a position closer to the front side F than the other wall 208*c;* and at least one portion of the latch 210 is located on the moving track of the striker 1. In the shown embodiment, when the catcher 2 is set in the turned position, a portion of the head 210*b* of the latch 210 close to the rotary shaft 205 of the catcher 2 and locating outside the hooking groove 208 is located on the moving track of the striker 1, which is depicted by swinging the swingable member D about the hinged portion of the swingable member D.

In a case where the swingable member D is swung toward the reference position, when the swingable member is swung up to the certain swung position, the striker 1 disposed on the swingable member D enters the hooking groove 208 of the catcher 2 in the standby position and is captured therein. The catcher 2, which has captured the striker 1, is turned (forward) beyond the intermediate position by the swinging operation of the swingable member D and is turned up to the turned position by the biasing action. The swingable member D, the striker 1 of which has been captured by the catcher 2, is forcibly swung up to the reference position by the turning operation of the catcher 2. Thus, the swingable member D, which has been swung toward the reference position, can be reliably closed. On the other hand, when the swingable member D, which is set in the reference position as described above, is swung toward an opening direction, the catcher 2, which has captured the striker 1 at the turned position, is turned (backward) beyond the intermediate position by the movement of the striker 1 and is set in the standby position by the biasing action. In the standby position, the striker 1 escapes from the hooking groove 208 to be released from the catcher 2 since the introduction port 208*a* of the hooking groove 208 is faced toward the front side F. Thus, the swingable member D is opened because of being released. On the other hand, the catcher 2 is kept in the standby position by the biasing action until the swingable member D is swung toward the reference position next. In a case where although the swingable member D is not set in the reference position, the catcher 2 is improperly set in the turned position (for example, a case where a portion of the catcher 2 is depressed in the standby position when projecting toward the front side F from the notched portion 30 of the casing 3, hereinbelow, referred to as the improper operation state), when the swingable member D is swung up to the reference position, the striker 1 is brought into contact with the latch 210 forming the one wall 208*b* of the hooking groove 208 to depress the latch 210 against the biasing force (from FIGS. 7(*a*) to (c)), and then the striker 1 can be captured, at a deeper position than the latch 210, by the hooking groove 208 of the catcher 2 set in the turned position since the latch 210 is elastically projected (FIG. 7(*d*)). Thus, the withdrawing mechanism can be restored to a proper operation state even after the withdrawing mechanism has been set in the improper operation state.

In this embodiment, the latch 210 has an inclined surface 210*c* formed on a side thereof, which faces outward when the catcher 2 is set in the turned position (which is outside the hooking groove 208), which is located on the moving track of the striker 1, and which is gradually raised toward the top of the latch 210 and faces toward the front side F.

In the shown embodiment, the head 210*b* of the latch 210 has a corner 210*d* formed on an end facing the rotary shaft of the catcher 2 so as to extend in substantially parallel with the first chord edge 203*a* as seen from the bottom of the catcher 2. The inclined surface is formed on the corner 210*d*.

In this embodiment, this arrangement allows the striker 1 to be brought into contact with the inclined surface 210*c* of the catcher 2 in the turned position from the front side F when the swingable member D is swung up to the reference position in the improper operation state. Thus, the latch 210 can be smoothly depressed against the biasing force, being assisted by the inclined surface 210*c*.

In this embodiment, the seat 210*a* of the latch 210 in the catcher 2 has a length substantially extending along the moving track of the striker when the catcher 2 is set in the turned position (FIG. 8).

In this embodiment, the seat 210*a* of the latch 210 has ribs 210*f* formed on both sides extending along the longitudinal direction of the seat 210*a* and at positions close to a front end 210*e* of the seat 210*a* of the latch 210, which is located on the front side F when the catcher 2 is set in the turned position. The ribs are formed sc as to extend along the moving direction of the seat 210*a*, and the guide slot 214 has guide grooves 214*b* formed so as to house the ribs 210*f*.

In this embodiment, although the striker 1 is brought, from the front side F, into contact with the latch 210 of the catcher 2 in the turned position and depresses the latch 210 against the biasing force when the swingable member D is swung up to the reference position in the improper operation state, the latch 210 can be reliably depressed, minimizing, e.g. the inclination of the seat 210*a* of the latch 210.

In this embodiment, the seat 210*a* has auxiliary ribs 210*g* formed on both ends so as to extend along the moving direction of the seat 210*a*, and the guide slot 214 has auxiliary guide grooves 214*c* formed so as to house the auxiliary ribs 210*g*.

In this embodiment, in a case where the swingable member D is swung up to the reference position in the improper operation state, when the striker 1 is brought, from the front side F, into contact with the latch 210 of the catcher 2 in the turned position, it is possible to minimize the inclination of the seat 210*a* of the latch 210 in a width direction of the seat. In this case, the latch 210 can be reliably depressed.

In the shown embodiment, the outer peripheral edge of the semicircular plate 203 is formed as a pinion 203*c* between the hooking groove 208 and the second chord edge 203*b*. On the other hand, the casing 3 has a slider 5 incorporated therein on the one end on the depth side R of the catcher 2 so as to be movable along the longitudinal direction of the casing 3. The slider has a rack 50 in engagement with the pinion 203*c* of the catcher on an edge facing the front side F.

When the catcher 2 is set in the standby position, the slider is brought into contact with the one end of the casing 3. As the catcher 2 is moved toward the turned position, the slider 5 is moved toward the other end of the casing 3. In the shown embodiment, the casing 3 has the damper 6 housed therein so as to have a piston rod 60 movable along the longitudinal direction of the casing 3. The damper includes a cylinder 61 with an unshown piston and a viscous fluid, such as silicone oil, sealed therein and applies a damping force to the movement of the piston rod 60 into the cylinder 61 by utilizing the resistance of the viscous fluid. The distal end of the piston rod 60, which faces the one end of the casing 3, is fixed to an end of the slider 5 facing the other end of the casing 3. When the catcher 2 is set in the turned position, the piston rod 60 is pressed into the cylinder by a maximum length by the slider 5. Thus, the catcher 2 is prevented from being further turned beyond the turned position.

In the shown embodiment, this arrangement allows the damping force to be applied to the turning operation of the catcher 2 from the standby position toward the turned position, with the result that the swingable member D is swung at a slow speed in the final swinging stage toward the reference position. In particular, the damper 6 may be disposed at a position lateral to the catcher 2.

The damper 6 may be of a load response type. The damper may be configured so that the viscous fluid applies a larger resistance to the piston as the piston connected to the piston rod 60 is moved at a higher speed. In the shown embodiment, the damper 6 is formed of a damper disclosed in JP-A-2005-188693 by the applicant.

In a case where the swingable member D is swung toward the reference position, when the swingable member D is swung up to the certain swung position, the striker 1 disposed on the swingable member D is captured by the catcher 2 in the standby position. The catcher 2, which has captured the striker 2, is turned up to the turned position by the swinging force of the swingable member D. When the swingable member D is swung at such a high speed that the catcher 2 is turned at a high speed, the damper 6 applies a corresponding and relatively large damping force to the turning operation of the catcher 2. When the swingable member D is swung at such a low speed that the catcher 2 is turned at a low speed, the damper 6 applies a corresponding small damping force to the turning operation of the catcher 2. Thus, it is possible to effectively damp the swinging operation when the swingable member D is swung hard, while it is possible to prevent the resistance from being excessive at the certain swung position and thereafter when the swingable member D is normally swung toward the reference position.

In this embodiment, the spring load of the spring 4 biasing the catcher 2 may be set at a minimum value.

Each of FIG. 11 to FIG. 13 shows a case where the swingable member D has a swinging shaft Dc disposed between the one end and the other end thereof. Specifically, in each case, the swingable member has an arm De disposed on a main portion Dd at an end opposite to the free end. The arm De has the striker 1 disposed thereon, which is captured by the catcher 2 disposed on the main body of an automobile just before the completion of the swinging operation of the swingable member D when the swingable member D in an open position is swung toward the reference position.

In the case shown in FIG. 11 and FIG. 12, the main portion Dd of the swingable member forms the trunk lid T (an exterior member of the automobile). The arm De has one end connected to the front end of the trunk lid T and the other end formed with the striker 1, which is formed of a shaft extending in the left to right direction of the automobile. The casing 3 with the catcher 2 incorporated therein is disposed on the main body of the automobile, or on a top wall of the trunk room Ta in a depth position in the shown case. The trunk lid T has an intermediate portion of the arm De swingably supported on the main body of the automobile by the swinging shaft Dc on the open side of the trunk room Ta. In the shown case, when the trunk lid T is opened (set in an open position), the striker 1 is located in front of the catcher 2 (under the catcher in the shown case), and when the trunk lid T is swung toward a closed position (reference position), the striker 1 is captured by the catcher 2 in the standby position.

In the case shown in FIG. 13, the main portion Dd of the swingable member forms the glove box G (an exterior member of the automobile). The arm De has one end connected to a lower end of the glove box G and the other end formed with the striker 1, which is formed of a shaft extending in the left to right direction of the glove box G. The casing 3 with the catcher 2 incorporated therein is disposed on the main body of the automobile, or on the side wall of the housing Ga of the glove box G in the shown case. The glove box G has a front portion of the arm De swingably supported on the main body of the automobile by the swinging shaft Dc on the open side Gb of the housing Ga. In the shown case, when the glove box G is opened (set in an open position), the striker 1 is located in front of the catcher 2 (above the catcher in the shown case), and when the glove box G is swung toward a closed position (reference position), the striker 1 is captured by the catcher 2 in the standby position.

FIG. 14 to FIG. 24(*c*) show an embodiment wherein the structure of the withdrawing mechanism is partly modified. The embodiment shown in FIG. 14 to FIG. 24(*c*) is basically different from the embodiment shown in FIG. 1 to FIG. 10 in that the structures of the striker 1 and the catcher 2 are modified.

In the modified embodiment, the striker 1 is formed of a pin 14, which is assembled to a striker base 13 so as to be protrudable. In the modified embodiment, the striker base 13 has a distal end formed with an arm shape having a cylindrical supporter 13*a*, which projects upward. The striker base 13 is configured to have a rear end mounted to the swingable member D (specifically, an upper portion of a door as in the embodiment shown in FIG. 1 to FIG. 10). The pin 14 is housed in the cylindrical supporter 13*a* so as to have the top end constantly projecting outward from a top open end 13*b* of the cylindrical supporter 13*a* by a biasing member, such as an unshown spring, which is housed in the cylindrical supporter 13*a*. Further, the pin 14 is configured to have a protruded portion 14*a* formed so as to be retractable in the cylindrical supporter 13*a* by being depressed against the biasing action of the spring as described above. In the modified embodiment, the protruded portion 14*a* of the pin 14 includes an inclined surface 14*b*, which is formed on an end facing forward when the swingable member D in an open position is swung toward the reference position, and which is formed so as to gradually decrease the diameter of the pin 14 toward the top end of the pin 14.

On the other hand, in the modified embodiment, the sub-part 218 forming the catcher 2 has an outer edge 218*g* of an arm 218*f* thereof (an edge remote from the hooking groove 208 in both edges along the longitudinal direction of the arm 218*f* of the sub-part 218) as described later. The outer edge 218*g* has a guide surface 218*h* formed thereon so as to face the front side F and to gradually increase the thickness of the sub-part 218 toward an inner edge of the sub-part 218. The sub-part is configured to have the outer edge 218*g* located on the moving track x of the striker 1 when the catcher 2 is set in the turned position.

In a case where although the swingable member D is not set in the reference position, the catcher 2 has been improperly set in the turned position (in the improper operation state), when the swingable member D is swung up to the reference position, the pin 14 forming the striker 1 is brought into contact with the outer edge 218*g* of the sub-part 218 and is retracted against the biasing force (from FIGS. 24(*a*) to (*b*)), the pin 14 is allowed to climb over the sub-part. When the pin 14 has climbed over the sub-part 218, the pin 14 is protruded again, allowing the striker 1 to be captured by the hooking groove 208 of the catcher 2 in the turned position (FIG. 24(*c*)). Thus, the withdrawing mechanism can be restored to the proper operation state. Unlike the withdrawing mechanism shown in FIG. 1 to FIG. 10, the withdrawing mechanism according to the modified embodiment can be released from the improper operation state with the thickness of the catcher 2 being minimized. The pin 14 is smoothly retracted against the biasing force by a combination of the inclined surface 14*b* of the pin 14 and the guide surface 218*h* of the sub-part 218.

In the modified embodiment shown in FIG. 14 to FIG. 24(*c*) as well, the catcher 2 is turnably incorporated in the casing 3, which has an open bottom and is formed as a box having a substantially rectangular parallelepiped shape. The casing 3 has a top wall 32, through the outer side of which the casing 3 is mounted to the upper section Hc of the door frame Ha to dispose the catcher 2 on the upper section Hc of the door frame Ha.

In the modified embodiment as well, the casing 3 has the catcher 2 disposed on one end therein. The casing has a notched portion 30 formed in a side wall on the one end with the catcher 2 and facing the front side F. The catcher 2 partly projects outward from the notched portion 30 when being set in the standby position. When the swingable member D is swung up to a certain swung position, the striker 1 enters the hooking groove 208 of the catcher 2 in the standby position and passes the intermediate position, with the result that the catcher 2 is turned to the turned position (the position shown in FIG. 20) to withdraw the striker 1 into the casing 3 so as to set the swingable member D in the reference position, closing the swingable member D.

In the modified embodiment as well, the catcher 2 is configured so as to be turnable between the standby position and the turned position and is also configured so as to be biased toward the standby position when being at a position closer to the standby position than the intermediate position between the standby position and the turned position and to be biased toward the turned position when being at a position closer to the turned position than the intermediate position.

In the shown modified embodiment, the catcher 2 is formed of a combination of the main part 217 and the sub-part 218.

The main part 217 is formed in a substantially sector shape. The main part 217 in such a substantially sector shape has a shaft hole 217*a* formed in a convergent portion of the sector shape. The rotary shaft 205, which is mounted to the casing 3 as a supporter 33 so as to extend the axis thereof in an upward and downward direction, and which has a head formed on a lower edge, passes through the shaft hole 217*a*, combining the main part 217 with the rotary shaft 205. The main part 217 has an arced portion 217*b* formed with a pinion 217*c*, which is brought into engagement with a rack 50 of a slider 5. The explanation of the structures of the slider 5 and the damper 6 will be omitted since the structures are substantially the same as those of the embodiment shown in FIG. 1 to FIG. 10.

The sub-part 218 includes a circular base 218*a* and the arm 218*f*, which has a base end integrally connected to the base 218*a* so as to project from the base 218*a*. The base 218*a* has an elongated hole 218*b* formed therethrough. The elongated hole 218*b* is configured to have a width substantially equal to the outer diameter of the above-mentioned rotary shaft 205 and a length slightly larger than the outer diameter of the rotary shaft 205. By passing the rotary shaft 205 through the elongated hole 218*b*, the sub-part 218 is combined with the rotary shaft 205, interposing the base 218*a* between the inner side of the top wall 32 of the casing 2 and the upper side of the main part 217. The sub-part 218 is combined with the main part 217 so as to form an elongated space between one of the opposed edges of the arm 218*f* extending in the longitudinal direction and one of the opposed linear edges 217*d* extending from a portion of the main part 217 with the shaft hole 217*a* formed therein to the arced portion 217*b*. In the catcher 2, the elongated space forms the hooking groove 208 for the striker 1, which has an introduction port 208*a* directed to the front side F in the standby position. In the standby position, the arm 218*f* of the sub-part 218 is located in front of the one linear edge 217*d* of the main part 217, the distal end of the arm 218*f* is located at a position lateral to the moving track x of the striker 1, and the outer end of the one linear edge 217*d* of the main part 217 is located on the moving track x of the striker 1 (FIG. 14).

The main part 217 has a bottom side formed with a fixing portion 217*e* at a position close to the introduction port 208*a* of the hooking groove 208 so as to fix a front spring end 40. The catcher 2 is configured to be biased by a tension coil spring 40, which is housed in the casing 3 so as to have a rear end 41 thereof fixed to the other end of the casing 3 as in the embodiment shown in FIG. 1 to FIG. 10. The spring 40 is extended by a maximum length in the intermediate position of the catcher 2 where the front spring end 40 of the spring 40, the rotary shaft 205 of the catcher 2 and the rear spring end 41 of the spring 40 are set on the same imaginary line. By this arrangement, the catcher 2 is stably set in both of the standby position (FIG. 14) and the turned position with the introduction port 208*a* of the hooking groove 208 facing the depth direction (FIG. 20) by the biasing action of the spring 40.

The base 218*a* of the sub-part 218 forming the catcher 2 has a coupling projection 218*e* formed thereon so as to be housed in a coupling hole 217*f*, which is formed in the main part 217 at a position close to the shaft hole 217*a*. The coupling hole 217*f* is configured to house the coupling projection 216*e* with slight play. In a case where the swingable member D is swung toward the reference position, when the swingable member is swung up to the certain swung position, the striker 1 disposed on the swingable member D is brought into contact with the one linear edge 217*d* facing the hooking groove 208 of the main part 217 forming the catcher 2. When the striker 1 collides as described above, the main part 217 is turned about the rotary shaft 205, and the sub-part 218, which is coupled with the main part 217 by a combination of the coupling hole 217*f* and the coupling projection 218*e*, is turned along with the main part 217. As a result, the introduction port 208*a* of the hooking groove 208 is gradually directed to the depth direction, and the catcher 2 captures the striker 1. The catcher 2, which has captured the striker 1, is turned (forward) beyond the intermediate position by the swinging operation of the swingable member D and is turned up to the turned position by the biasing action. The swingable member D, the striker 1 of which has been captured by the catcher 2, is forcibly swung up to the reference position by the turning operation of the catcher 2. Thus, the swingable member D, which has been swung toward the reference position, can be reliably closed. On the other hand, when the swingable member D, which is set in the reference position as described above, is swung toward an opening direction, the catcher 2, which has captured the striker 1 at the turned position, is turned (backward) beyond the intermediate position by the movement of the striker 1 and is set in the standby position by the biasing action. In the standby position, the striker 1 escapes from the hooking groove 208 to be released from the catcher 2 since the introduction port 208*a* of the hooking groove 208 is faced toward the front side F. Thus, the swingable member D is opened because of being released. On the other hand, the catcher 2 is kept in the standby position by the biasing action until the swingable member D is swung toward the reference position next.

In the modified embodiment, it should be noted that the sub-part 218 moves in a direction to expand the introduction port 208*a* of the hooking groove 208 as the catcher 2 in the turned position is turned backward to the standby position. By this arrangement, when the catcher 2 is set in the turned position, the width of the hooking groove 208 is set at such a value that the striker 1 can be housed with slight play, while when the catcher 2 is set in the standby position, the striker can be properly introduced into the hooking groove 208 through the introduction port 208*a* even if a slight shift or misalignment occurs in the moving track of the striker 1. Specifically, when the withdrawing mechanism is applied to a door, even if a slight shift or misalignment occurs in the moving track of the striker 1 due to deformation in the door frame, the application of an external force or any other factor after provision of the withdrawing mechanism, the swinging operation of the swingable member D toward the reference position is prevented from striking the striker 1 against the outer edge 218*g* of the sub-part 218 by slightly widening the introduction port 208*a* of the hooking groove 208 of the catcher 2 in the standby position.

In the modified embodiment, the sub-part 218 has a slider 218*i* formed thereon at a position lateral to the rotary shaft 205 passing through the elongated hole 218*b*, the slider being guided in a trace groove 33*c* formed in the supporter 33 for the rotary shaft 205 and extending in an arced shape. The-sub-part 217 is slid in the length range of the elongated hole 218*b* according to a change in the pitch between the trace groove 33*c* and the rotary shaft 205 as the catcher 2 turns backward toward the standby position.

In the shown modified embodiment, the slider 218*i* is formed of a protrusion 218*j*, which is formed on a top side of the base 218*a* of the sub-part 218 so as to be alignment with the coupling projection 218*e*. The trace groove 33*c* is formed in a plate 33*a* at a position lateral to a through hole 33*f* for the rotary shaft 205, the plate being disposed inside the casing 3 so as to extend along the inner side of the top wall 32 of the casing 3 (FIG. 23). The rotary shaft 205 is mounted to the top wall 32 of the casing 3, being put into the through hole 33*f*. The trace groove 33*c* is located behind the through hole 205 and is formed so as to have an inner curved edge facing the rotary shaft 205. The slider 218*i* is located at one groove end 33*d* of the trace groove 33*c*, or one groove end of the trace groove 33*c* close to the piston in the shown modified embodiment, when the catcher is set in the turned position. The slider 218*i* is located at the other groove end 33*e* of the trace groove

33*c* when the catcher is set in the standby position. Although the pitch is almost constant between the trace groove 33*c* and the rotary shaft 205 in an area from the one groove end 33*d* to a position just before the other groove end 33*e* so that the trace groove 33*c* extends along an arc of an imaginary circle about the rotary shaft 205 in such an area, the pitch is slightly narrower than the radius of the imaginary circle at a position close to the other groove end 33*e*.

In the shown modified embodiment, by this arrangement, the sub-part 218 of the catcher 2, which is turned backward from the turned position, locates the rotary shaft 205 at one end 218*c* of the elongated hole 218*b* just before the catcher is set in the standby position, and when the catcher is set in the standby position, the sub-part is moved to locate the rotary shaft 205 at the other end 218*d* of the elongated hole 218*b* since the slider 218*i* of the sub-part is pushed by the trace groove 33*c*. This movement widens the introduction port 208*a* of the hooking groove 208 of the catcher 2 in the standby position (from FIG. 17 to FIG. 14).

When the striker 1 is brought into contact with the one linear edge 217*d* of the main part 217 of the catcher 2 in the standby position, the trace groove 33*c* pulls the slider 218*i* in a direction away from the rotary shaft 205 since the catcher 2 is turned backward. Thus, the sub-part 218 is moved again so as to locate the rotary shaft 205 at the one end 218*c* of the elongated hole 218*b*. This movement narrows the introduction port 208*a* of the hooking groove 208 of the catcher 2 in the standby position (from FIG. 14 to FIG. 17). In the shown modified embodiment, the sub-part 218 has a rib 218*k* formed on a top side at a position with the arm 218*f* extending therefrom, the rib extending along an arc of an imaginary circle coaxial with the above-mentioned imaginary circle, and the plate has a groove 33*b* formed therein so as to extend along the arc of the imaginary circle that the rib 218*k* extends along. After the sub-part 218 is moved again so as to locate the rotary shaft 205 at the one end of the elongated hole 218*b*, the rib 218*k* enters the groove 33*b*, allowing the sub-part 218 to be turned about the rotary shaft 205 without a shake.

In the modified embodiment, the casing 3 includes an assist part 34 disposed on the one end. The assist part has a toothed portion 34*c* formed on one end 34*a* so as to be brought into engagement with the rack 50 of the slider 5 at least when the catcher 2 is set between the standby position and the intermediate position. The assist part is turnably supported between the one end 34*a* and the other end 34*b* thereof by the casing 3. The other end 34*b* of the assist part has one end 34*f* of a torsion coil spring 34*d* fixed thereto. The torsion coil spring 34*d* has the other end 34*e* fixed to the casing 3 and a coiled portion 34*g* set in a free state. When the catcher 2 is started to be turned from the standby position toward the turned position, the assist part 34 is turned in a direction to bring the one end 34 of the assist part 34 closer to a cylinder 61. By the turning operation of the assist part 34, the distance between both ends 34*e* and 34*f* of the spring 34*d* is decreased to the minimum value just before the catcher 2 arrives at the intermediate position. When the catcher 2 is set in the intermediate position, the spring 34*d* is configured to bias the one end 34*a* of the assist part 34 so as to be further closer to the cylinder 61. In the modified embodiment, when the catcher 2 has been turned forward up to the intermediate position, the assist part 34 applies a biasing force to the slider 5 in a direction to push the slider 5 toward the other end of the casing 3, with the result that the catcher 2 can be smoothly turned toward the turned position beyond the intermediate position. This arrangement prevents the catcher 2 from jamming in the intermediate position when the catcher is turned forward. Thus, the swingable member D, the striker 1 of which has been captured by the catcher 2, can be reliably swung up to the reference position. The spring 34*d* is mounted in the casing 3 so that when the catcher 2 is turned backward and passes the intermediate position by the backward movement of the swingable member D toward an open position, the distance between both ends 34*e* and 34*f* of the spring 34*d* is decreased to the minimum value, and then the spring 34*d* biases the one end 34*a* of the assist part 34 in a direction away from the cylinder 61.

FIG. 25 shows a further modified embodiment wherein the structure of the withdrawing mechanism shown in FIG. 14 to FIG. 24(*c*) is partly modified. In the modified embodiment shown in FIG. 25, the coupling device for coupling the catcher and the damper is mainly different from that of the embodiment shown in FIG. 14 to FIG. 24(*c*). The other structures than the coupling device in the embodiment shown in FIG. 25 are substantially the same as those of the embodiment shown in FIG. 14 to FIG. 24(*c*). In FIG. 25, similar parts are designated by the same reference numerals as those used in FIG. 14 to FIG. 24(*c*). The explanation of the similar parts will be omitted.

In the embodiment shown in FIG. 25, the damper 6 is housed between a fit-in portion for a piston rod 60 connected to a piston (hereinbelow, referred to as the rod fit-in portion 7) and a fit-in portion for a rear end 61*a* of a cylinder 61 remote from an end of the cylinder with the piston rod 60 projecting therefrom (hereinbelow, referred to as the cylinder fit-in portion 8). Specifically, in the further modified embodiment, the casing 3 formed in an elongated shape has the catcher 2 disposed on one end 3' thereof, the rod fit-in portion 7 disposed at a position closer to the catcher 2 between the catcher 2 and the other end 3" thereof, and the cylinder fit-in portion 8 disposed on the other end 3" therein. The damper 6 is held so as to be clamped between both fit-in Portions 7 and 8. The damper 6 is held between both fit-in portions 7 and 8 so as to extend the moving direction of the unshown piston along the longitudinal direction of the casing 3. The damper 6 is held with play through a through hole for the cylinder 61, which is formed in a holding portion 35 at a position closer to the front side F with respect to an imaginary straight line y passing substantially through the center in the width direction of the casing 3.

The casing includes a coupling pinion 36, which is disposed at a position lateral to the catcher 2 between the catcher 2 and an outer end 60*a* of the piston rod 60 of damper 6, and which is rotatably assembled to the casing 3 so as to have a rotary axis in parallel with the rotary shaft of the catcher 2.

The casing 3 includes a first slider 501 with racks 501*a* respectively in engagement with the pinion 217*c* of the catcher 2 and with the coupling pinion 36, and a second slider 502 with a rack 502*a* in engagement with the coupling pinion 36 on a side remote from the first slider 501.

In the further modified embodiment, the cylinder fit-in portion 8 is shifted by the movement of the first slider 501, and the rod fit-in portion 7 is shifted by the movement of the second slider 502.

More specifically, the first slider 501 and the second slider 502 are assembled to the casing 3 so as to regularly make both sliding movement toward the one end 3' of the casing 3 and sliding movement toward the other end 3" along the longitudinal direction of the casing 3. The first slider 501 is disposed at a position closer to the depth side R with respect to the above-mentioned imaginary straight line y, the rotation center 36*a* of the coupling pinion 36 is located on the imaginary straight line y, and the second slider 502 is disposed at a position closer to the front side F with respect to the imaginary straight line y. The first slider 501 includes a rack 501*a*, which is disposed behind the pinion 217*c* of the catcher 2 and has a certain length so as to be brought into engagement with the pinion 217*c*, and a rack 501*a*, which is disposed behind the coupling pinion 36 and has a certain length so as to be brought into engagement with the coupling pinion 36. In the further modified embodiment, the second slider 502 has the outer end 60*a* of the piston rod 60 assembled to an end thereof closer to the other end 3" of the casing 3. The end of the second slider closer to the other end 3" of the casing 3 serves as the rod fit-in portion 7. The slider 501 has an extension bar 504 coupled thereto through a coupling 503 between the slider 501 and the other end 3" of the casing 3 so that the extension bar can be slid along with the first slider 501. The extension bar 504 has a projection 504*a* disposed on an end close to the other end 3" of the casing 3 so as to project toward the front side F and be brought into contact with the rear end 61a of the cylinder 61 from a side close to the other end 3" of the casing 3. In the further modified embodiment, the projection 504*a* serves as the cylinder fit-in portion 8.

When the catcher 2 is set in the standby position, the piston rod 60 projects from the cylinder 61 by a maximum length (FIG. 25).

When the catcher 2 captures the striker 1 and is turned toward the turned position, the first slider 501, the rack 501*a* of which is brought into engagement with the pinion 217*c* of the catcher 2, is slid toward the one end 3' of the casing 3, and the cylinder fit-in portion 8 is moved toward the end 3' of the casing 3. On the other hand, when the first slider 501 is moved in this way, the coupling pinion 36 is also turned, the second slider 502, the rack 502*a* of which is brought into engagement with the turned coupling pinion 36 on a side opposite to the first slider 501, is moved toward the other end 3" of the casing in the reverse direction to the first slider 501. By this arrangement, the first slider 501 and the second slider 502 can cause the piston to be pushed into the cylinder 61 forming the damper 6 by a greater turning amount than the turning amount of the catcher 2 that is turned from the standby position to the turned position. Thus, the damping force of the load response type damper 6 can be maximally applied to the swingable member D just before the swingable member D is set in the reference position.

When the swingable member D that has been set in the reference position is swung backward to an open position, the catcher 2 is also turned backward to the standby position. As a result, the first slider 501 is moved toward the other end 3" of the casing 3, the second slider 502 is moved toward the one end 3' of the casing 3, and the piston rod 60 is returned to such a state that the piston rod has projected from the cylinder 61 by the maximum length (FIG. 25).

In the further modified embodiment, it should be noted that a tension coil spring 4 is configured so as to selectively set the catcher 2 in the standby position and the turned position by its biasing force through the coupling pinion 36. In the further modified embodiment, the tension coil spring 4 and the coupling pinion 36 are combined together through a coupling rod 42, which has one end assembled to a position 36*b* off-center from the rotation center 36*a* of the coupling pinion 36 and the other end fixed to a front spring end 40 of the tension coil spring 4. The tension coil spring 4 has a rear spring end 41 fixed to a projection 37, which projects from the inner side of the casing 3 through a through hole 504*b* formed in the extension bar 504 having an elongated shape in the moving direction of the extension bar 504. When the front spring end 40, the rear spring end 41 and the rotation center 36*a* of the coupling pinion 36 are located on an imaginary single straight line, the tension coil spring is extended by a maximum length. At this time, the catcher 2 is set in the intermediate position through the first slider 501.

What is claimed is:

1. A withdrawing mechanism comprising:

a striker disposed on one of a swingable member and a main body with the swingable member swingably assembled thereto;

a catcher disposed on the other of the swingable member and the main body, and configured to capture the striker moving from a front side of the catcher when the swingable member swings from an open position toward a reference position, said catcher being turnable forward and backward between a standby position and a turned position to capture the striker in the standby position and turn forward to the turned position;

a damper for applying a damping force to a turning operation of the catcher toward the turned position; and a casing having the catcher and the damper disposed therein;

wherein the catcher is configured so as to be biased toward the standby position when being at a position closer to the standby position than an intermediate position between the standby position and the turned position and to be biased toward the turned position when being at a position closer to the turned position than the intermediate position; and wherein the catcher includes a hooking groove for capturing the striker on a surface of the catcher, said hooking groove extending substantially perpendicular to a rotary shaft of the catcher, the hooking groove having an introduction port facing toward the front side in the standby position, and the catcher rotationally attached to the casing on the rotary shaft directly without sliding to the casing so that the striker captured on the catcher rotationally moves between the standby position and the turned position.

2. The withdrawing mechanism according to claim 1, wherein the damper includes a piston and a cylinder and is configured to provide a resistance of a viscous fluid sealed in the cylinder to a depression movement of the piston;

wherein the catcher has a pinion formed thereon, and a slider having a rack engageable with the pinion is disposed in the casing; and wherein the slider is combined with the piston of the damper.

3. The withdrawing mechanism according to claim 1, wherein the casing has at least two mounting surfaces in a stepped fashion, the withdrawing mechanism being adapted to be mounted to the main body through the casing.

4. The withdrawing mechanism according to claim 1, wherein the hooking groove has opposed walls, one of which is formed of a latch biased to project from a base surface of the surface; and wherein when the catcher is set in the turned position, the one wall of the hooking groove is configured to be set in a position closer to a front side than the other wall, and at least one portion of the latch is configured to be located on a moving track of the striker.

5. The withdrawing mechanism according to claim 4, wherein the latch has an inclined surface formed at a portion on a side thereof, which faces outward when the catcher is set in the turned position, which is located on the moving track of the striker, and which is gradually raised toward a top of the latch and faces toward the front side.

6. The withdrawing mechanism according to claim 4, wherein the latch includes a seat, which has an outer profile formed in a substantially rectangular parallelepiped shape, and the latch is assembled to the catcher, having the seat housed in a guide slot so as to be movable in an extending direction of the guide slot, the guide slot having a slot shape following the outer profile of the seat; and wherein the seat has a length substantially extending along the moving track of the striker when the catcher is set in the turned position.

7. The withdrawing mechanism according to claim 6, wherein the seat has ribs formed on both sides extending along a longitudinal direction of the seat and at positions close to a front end of the seat of the latch, which is located on the front side when the catcher is set in the turned position, the ribs extending along a moving direction of the seat; and wherein the guide slot has guide grooves formed so as to house the ribs.

8. The withdrawing mechanism according to claim 7, wherein the seat has auxiliary ribs formed on both ends so as to extend along the moving direction of the seat; and wherein the guide slot has auxiliary guide grooves formed so as to house the auxiliary ribs.

9. The withdrawing mechanism according to claim 1, wherein the swingable member comprises a fixture swingably disposed in a house, a member swingably assembled to equipment in a house, a member swingably assembled to a main body of an electrical appliance, a member swingably assembled to a main body of business equipment, or an exterior member or an interior member swingably assembled to a main body forming an automobile.

10. The withdrawing mechanism according to claim 4, further comprising a compression coil spring to bias the latch outwardly so that when the striker contacts the latch at a side opposite to the hooking groove, the latch retracts inside the catcher to thereby allow the striker entering into the hooking groove.

* * * * *